US008063641B2

(12) United States Patent
Clark et al.

(10) Patent No.: US 8,063,641 B2
(45) Date of Patent: Nov. 22, 2011

(54) MAGNETIC RANGING AND CONTROLLED EARTH BOREHOLE DRILLING

(75) Inventors: Brian Clark, Sugar Land, TX (US); Jan S. Morley, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 831 days.

(21) Appl. No.: 12/139,320

(22) Filed: Jun. 13, 2008

(65) Prior Publication Data

US 2009/0308657 A1 Dec. 17, 2009

(51) Int. Cl.
*G01V 3/08* (2006.01)
*G01V 3/12* (2006.01)

(52) U.S. Cl. ..... 324/345; 324/346

(58) Field of Classification Search ..... 324/345, 324/346

See application file for complete search history.

(56) References Cited

U.S. PATENT DOCUMENTS

| | | | | |
|---|---|---|---|---|
| 3,731,752 | A | 5/1973 | Schad | |
| 4,710,708 | A | 12/1987 | Rorden et al. | |
| 5,268,970 | A | 12/1993 | Tanaka | |
| 5,485,089 | A | 1/1996 | Kuckes | |
| 5,585,726 | A | 12/1996 | Chau | |
| 5,923,170 | A | 7/1999 | Kuckes | |
| RE036,569 | E | 2/2000 | Kuckes | |
| 6,241,028 | B1 | 6/2001 | Bijleveld et al. | |
| 7,568,532 | B2 * | 8/2009 | Kuckes et al. | 175/40 |

FOREIGN PATENT DOCUMENTS

| | | | |
|---|---|---|---|
| JP | 10-061365 | A | 8/1996 |
| JP | 2001-141408 | A | 11/1999 |

OTHER PUBLICATIONS

Grills et al., "Magnetic Ranging Technologies for Drilling Stream Assisted Gravity Drainage Wells Pairs and Unique Well Geometries," SPE 79005 (2002).

Kuckes et al., "New Electromagnetic Surveying/Ranging Method for Drilling Parallel, Horizontal Twin Wells," SPE 27466 (1996).

* cited by examiner

*Primary Examiner* — Reena Aurora

(74) *Attorney, Agent, or Firm* — John Vereb; Jeremy Welch

(57) ABSTRACT

A method for determining the distance and/or direction of a second earth borehole with respect to a first earth borehole, includes the following steps: providing, in the first borehole, first and second spaced apart magnetic field sources; providing, in the second borehole, a magnetic field sensor subsystem for sensing directional magnetic field components; activating the first and second magnetic field sources, and producing respective first and second outputs of the magnetic field sensor subsystem, the first output being responsive to the magnetic field produced by the first magnetic field source, and the second output being responsive to the magnetic field produced by the second magnetic field source; and determining distance and/or direction of the second earth borehole with respect to the first earth borehole as a function of the first output and the second output.

40 Claims, 16 Drawing Sheets

MAGNETIC RANGING AND CONTROLLED EARTH BOREHOLE DRILLING

FIELD OF THE INVENTION

This invention relates to systems and methods for magnetic ranging between earth boreholes, and for controlled drilling of an earth borehole in a determined spatial relationship with respect to another existing earth borehole.

BACKGROUND OF THE INVENTION

In the quest for hydrocarbons, the need can arise for drilling of an earth borehole in a determined spatial relationship with respect to another existing borehole. One example is the so-called steam-assisted gravity drainage ("SAGD") process which is used to enhance production from an existing section of a generally horizontal production wellbore in a reservoir of high viscosity low-mobility crude oil. A second wellbore, to be used for steam injection, is drilled above and in alignment with the production wellbore. The injection of steam in the second wellbore causes heated oil to flow toward the production well, and can greatly increase recovery from the reservoir. However, for the technique to work efficiently, the two boreholes should be in good alignment at a favorable spacing over the length of the production region.

Referring to FIG. 1, a pair of SAGD wells 10 and 20 are shown in the process of being constructed. The lower well is drilled first and then completed with a slotted liner in the horizontal section. The lower well 10 is the producer well and is located with respect to the geology of the heavy oil zone. Typically, the producer well is placed near the bottom of the heavy oil zone. The second well 20 is then drilled above the first well, and is used to inject steam into the heavy oil formation. The second, injector well is drilled so as to maintain a constant distance above the producer well throughout the horizontal section. Typically, SAGD wells are drilled in Canada to maintain a vertical distance of 5±1 meters above the horizontal section, and remain within ±1 meters of the vertical plane defined by the axis of the producer well. The length of the horizontal section can typically vary from approximately 500 meters to 1500 meters in length. Maintaining the injector well precisely above the producer well and in the same vertical plane is beyond the capability of conventional MWD direction and inclination measurements.

Instead, magnetic ranging is typically used to determine the distance between the two wells and their relative position. In U.S. Pat. No. 5,485,089, a magnetic ranging method is described where a solenoid is placed in one well and energized with current to produce a magnetic field. This solenoid (e.g. 12 in FIG. 1, which also depicts magnetic field B) comprises a long magnetic core wrapped with many turns of wire. The magnetic field from the solenoid has a known strength and produces a known field pattern that can be measured in the other well, for example by a 3-axis magnetometer (represented at 21 in FIG. 1) mounted in a measurement while drilling (MWD) tool. The solenoid must remain relatively close to the MWD tool for the magnetic ranging. The solenoid is pushed along the horizontal section of the well using a wireline tractor (e.g. 14 in FIG. 1), or coiled tubing, or it can be pumped down inside tubing (not shown).

In a typical sequence of operations, the bottom hole assembly (BHA) in the second well drills ahead a distance of 10 m to 90 m, corresponding to one to three lengths of drill pipe. The distance between measurements depends on the driller's ability to keep the well straight and on course. The drilling operation must be halted to perform the magnetic ranging operation. U.S. Pat. No. 5,485,089 teaches that first, the 3-axis magnetometers in the MWD tool measure the (50,000 nTesla) Earth's magnetic field with the current in the solenoid off. Then the solenoid is activated with DC current to produce a magnetic field which adds to the Earth's magnetic field. A third measurement is made with the DC current in the solenoid reversed. The multiple measurements are made to subtract the Earth's large magnetic field from the data obtained with the solenoid on.

The solenoid is then moved to a second position along the completed wellbore by a tractor or by other means. If the first position is slightly in front of the MWD magnetometer (i.e. closer to the toe of the well), then the other position should be somewhat behind the MWD magnetometer (i.e. closer to the heel of the well). The solenoid is again activated with DC current, and the MWD magnetometers make the fourth measurement of the magnetic field with DC current. The DC current in the solenoid is then reversed, and a fifth measurement is made. The five magnetic field measurements are transmitted to the surface where they are processed to determine the position of the MWD tool magnetometers with respect to the position of the solenoid.

There are drawbacks to this process. First, the solenoid must be physically moved between the two borehole positions, during which time the BHA is not drilling. This movement requires that the tractor be activated and driven along the wellbore, which is time consuming. Second, any errors in measuring the two axial positions of the solenoid, or errors in the distance the solenoid moves, introduce errors in the calculated distance between the two wells. Third, since the solenoid is driven from one position to another, the distance the solenoid travels may vary from one magnetic ranging operation to the next. Since the MWD tool does not know how far the solenoid moved, it cannot compute the distance to the first well. This means that all five magnetic field measurements must be transmitted to the surface via the typically slow MWD telemetry system. Only after the MWD measurements have been decoded at the surface and the appropriate algorithms processed (including knowledge of the two solenoid positions), can the distance between the two wells be determined and drilling resumed. Hence, this magnetic ranging process results in excess rig time and thus increases the cost of drilling the well.

Reference can also be made to U.S. Pat. Nos. 3,731,752, 4,710,708, 5,923,170 and Re. 36,569, and also to Grills et al, "Magnetic Ranging Technologies for Drilling Steam Assisted Gravity Drainage Wells Pairs and Unique Well Geometries". SPE 79005, 2002, and to "Kuckes et al., New Electromagnetic Surveying/Ranging Method for Drilling Parallel, Horizontal Twin Wells," SPE 27466, 1996.

It is among the objects of the present invention to provide improved magnetic ranging and improved distance and direction determination between wellbores and to improve controlled drilling of an earth borehole in a determined spatial relationship with respect to another existing earth borehole.

SUMMARY OF THE INVENTION

A form of the invention is directed to a method for determining the distance and/or direction of a second earth borehole with respect to a first earth borehole, including the following steps: providing, in the first borehole, first and second spaced apart magnetic field sources; providing, in the second borehole, a magnetic field sensor subsystem for sensing directional magnetic field components; activating the first and second magnetic field sources, and producing respective first and second outputs of the magnetic field sensor subsystem, the first output being responsive to the magnetic field produced by the first magnetic field source, and the second output being responsive to the magnetic field produced by the second magnetic field source; and determining said distance and/or direction of the second earth borehole with respect to the first earth borehole as a function of said first output and said second output.

In an embodiment of this form of the invention, the step of providing a magnetic field sensor subsystem comprises providing a subsystem for sensing x, y, and z orthogonal magnetic field components, the first output comprises sensed x, y and z magnetic field components responsive to the magnetic field produced by the first magnetic field source, and the second output comprises sensed x, y and z magnetic field components responsive to the magnetic field produced by the second magnetic field source. Also in this embodiment, the step of activating said first and second magnetic field sources comprises implementing AC energizing of the magnetic field sources. The first and second magnetic field sources can be activated sequentially, or can be activated simultaneously at different phases and/or frequencies. Also in this embodiment, the step of providing first and second spaced apart magnetic field sources comprises providing first and second solenoids on a common axis, and the common axis is substantially parallel to the axis of said first borehole.

In another embodiment of the described form of the invention, there is further provided, in the first borehole, a third magnetic field source, and the activating step includes activating the third magnetic field source and producing a third output of the magnetic field sensor subsystem, the third output being responsive to the magnetic field produced by the third magnetic field source. In this embodiment, the step of determining said distance and/or direction of the second earth borehole with respect to the first earth borehole comprises determining said distance and/or direction as a function of the first output, the second output, and the third output. Also in this embodiment, the step of providing first, second and third magnetic field sources comprises providing first, second and third solenoids on a common axis. If desired, more than three magnetic field sources can be employed.

In accordance with another form of the invention, a method is set forth for drilling of a second earth borehole in a determined spatial relationship to a first borehole, including the following steps: (a) providing, in the first borehole, a plurality of spaced apart magnetic field sources; (b) providing, in the second borehole, a directional drilling subsystem and a magnetic field sensor subsystem for sensing directional magnetic components; (c) activating a first and a second of said plurality of magnetic field sources, and producing respective first and second outputs of the magnetic field sensor subsystem, the first output being responsive to the magnetic field produced by the first magnetic field source, and the second output being responsive to the magnetic field produced by the second magnetic field source; (d) determining the distance and direction of the second earth borehole with respect to the first earth borehole as a function of the first output and the second output; (e) producing directional drilling control signals as a function of the determined distance and direction; and (f) applying the directional drilling control signals to the directional drilling system to implement a directional drilling increment of the second borehole. An embodiment of this form the invention further includes: advancing, in the first borehole the plurality of spaced apart magnetic field sources; and repeating said steps (c) through (f) to implement a further directional drilling increment of the second borehole. Also, an embodiment of this form of the invention includes measuring direction, inclination, and gravity tool face of the directional drilling subsystem, the directional drilling control signals also being a function of the measured direction, inclination, and gravity tool face.

In accordance with a further form of the invention, a system is set forth for monitoring the distance and/or direction of a second earth borehole with respect to a first earth borehole, including: a first subsystem movable through the first borehole, the first subsystem including a plurality of spaced apart magnetic field sources and an energizer module for activating at least a first and second of the magnetic field sources; and a second subsystem movable through the second borehole, and including a magnetic field sensor for sensing directional magnetic field components, the second subsystem being operative to produce a first output responsive to the magnetic field produced by the first magnetic field source and a second output responsive to the magnetic field produced by the second magnetic field source. The distance and/or direction of the second borehole with respect to the first borehole are determinable from the first and second outputs. In an embodiment of this form of the invention, a downhole processor is provided for determining said distance and/or direction as a function of the first and second outputs.

Among the advantages of the invention are the following: (1) A knowledge of the strength of the magnetic field sources is not required. This is important since the magnetic field sources may be located inside a steel casing which can have a high and variable magnetic permeability, which reduces the strength of the magnetic field outside the casing. Since the relative magnetic permeability of the casing is generally not known, this introduces an unknown variation in the magnetic field strength. However, the technique of the invention is not affected by the casing. (2) It is not necessary to move the downhole tool containing the two magnetic field sources during a measurement sequence. This reduces the amount of rig time required to make a magnetic ranging survey. (3) It is not necessary to actually know or to determine the position of the magnetometers (e.g. an MWD magnetometer device) with respect to the z direction. (4) Since the distance to the first well and the direction to the first well do not depend on the axial position of the magnetic field sources, the calculations can be performed downhole, e.g. in the processor of an MWD tool, and only the results sent to the surface via MWD telemetry. (5) It is not necessary to determine the distance and direction from the MWD magnetometer to either of the magnetic field sources. Rather, the distance and direction from the MWD magnetometer to the first well are obtained. (6) It is not necessary to move the downhole tool to a known z position in order to determine the direction from the magnetometers to the downhole tool. (7) With an AC drive for the magnetic field sources, it is not necessary to measure the magnetic field with positive DC current, and then to re-measure with negative DC current, to cancel Earth's magnetic field. This saves whatever rig time would be necessary for making two separate measurements and transmitting them to the surface.

Further features and advantages of the invention will become more readily apparent from the following detailed description when taken in conjunction with the accompanying drawings.

DETAILED DESCRIPTION

Figure 1:
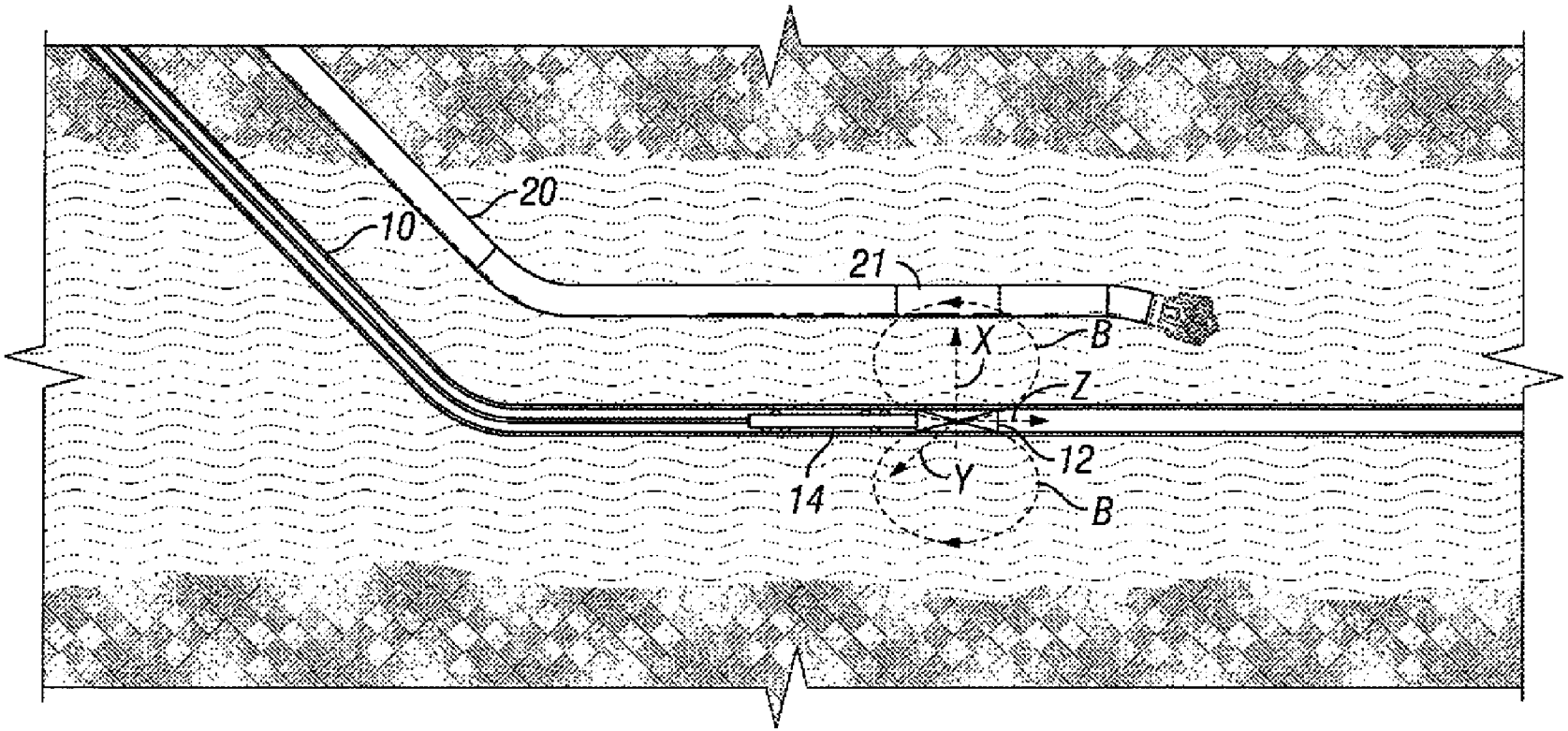
FIG. 1 is a diagram illustrating a prior art technique for magnetic ranging.
Figure 2A:
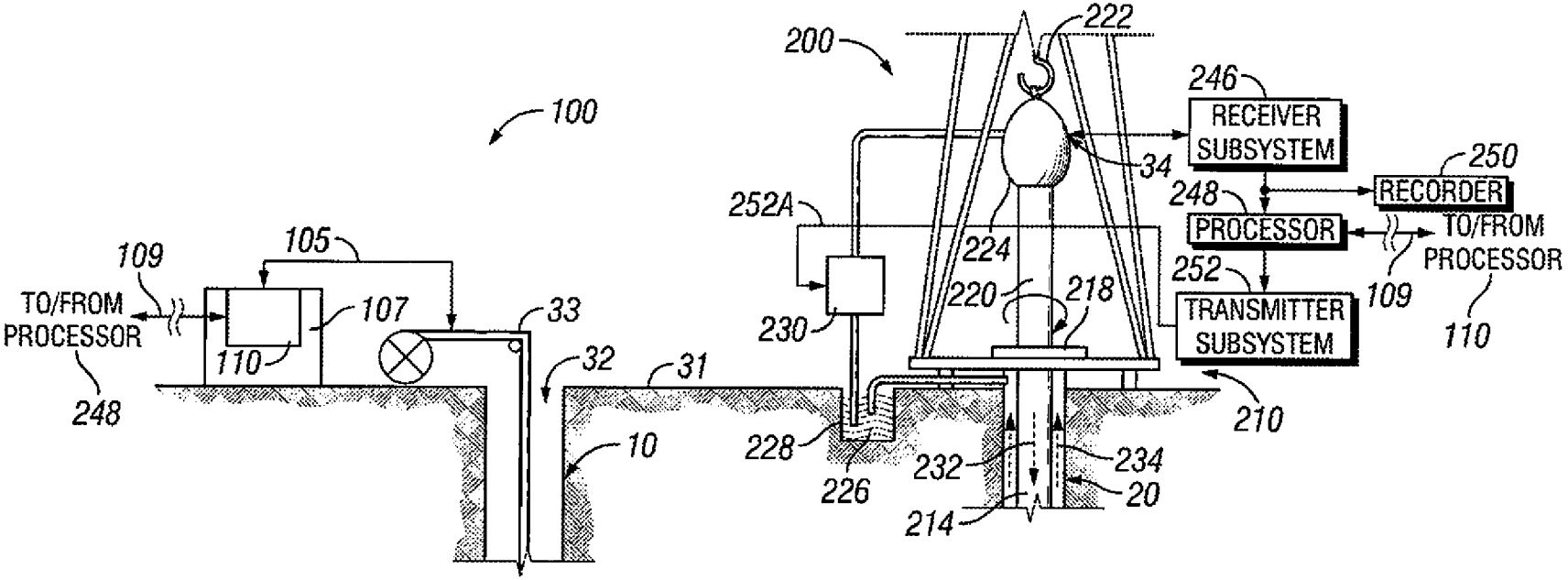
FIGS. 2A and 2B, when placed one over another, illustrate equipment which can be used in practicing embodiments of the invention.

FIG. 2A illustrates surface equipment of a type that can be used in practicing embodiments of the invention. Wireline equipment 100 operates in conjunction with the existing producer well 10 and drilling equipment 200 operates in conjunction with the well 20 being drilled and which, in this example, can ultimately be used as a steam injector well.

The wireline equipment includes cable 33, the length of which substantially determines the relative depth of the downhole equipment. The length of cable 33 is controlled by suitable means at the surface such as a drum and winch mechanism. The depth of the downhole equipment within the well bore can be measured by encoders in an associated sheave wheel, the double-headed arrow 105 representing communication of the depth level information and other signals to and/or from the surface equipment. Surface equipment, represented at 107, can be of conventional type, and can include a processor subsystem 110 and a recorder, and communicates with the downhole equipment. In the present embodiment, the processor 110 in surface equipment 107 communicates with a processor 248, which is associated with the drilling equipment. This is represented by double-headed arrow 109. It will be understood that the processors may comprise a shared processor, or that one or more further processors can be provided and coupled with the described processors.

The drilling equipment 200, which includes known measurement while drilling (MWD) capability, includes a platform and derrick 210 which are positioned over the borehole 20. A drill string 214 is suspended within the borehole and includes a bottom hole assembly which will be described further. The drill string is rotated by a rotating table 218 (energized by means not shown) which engages a Kelly 220 at the upper end of the drill string. The drill string is suspended from a hook 222 attached to a traveling block (not shown). The Kelly is connected to the hook through a rotary swivel 224 which permits rotation of the drill string relative to the hook. Alternatively, the drill string 214 may be rotated from the surface by a "top drive" type of drilling rig.

Drilling fluid or mud 226 is contained in a mud pit 228 adjacent to the derrick 210. A pump 230 pumps the drilling fluid into the drill string via a port in the swivel 224 to flow downward (as indicated by the flow arrow 232) through the center of drill string 214. The drilling fluid exits the drill string via ports in the drill bit and then circulates upward in the annulus between the outside of the drill string and the periphery of the borehole, as indicated by the flow arrows 234. The drilling fluid thereby lubricates the bit and carries formation cuttings to the surface of the earth. At the surface, the drilling fluid is returned to the mud pit 228 for recirculation. In the present embodiment, as will be described, a well known directional drilling assembly, with a steerable motor, is employed.

Figure 2B:
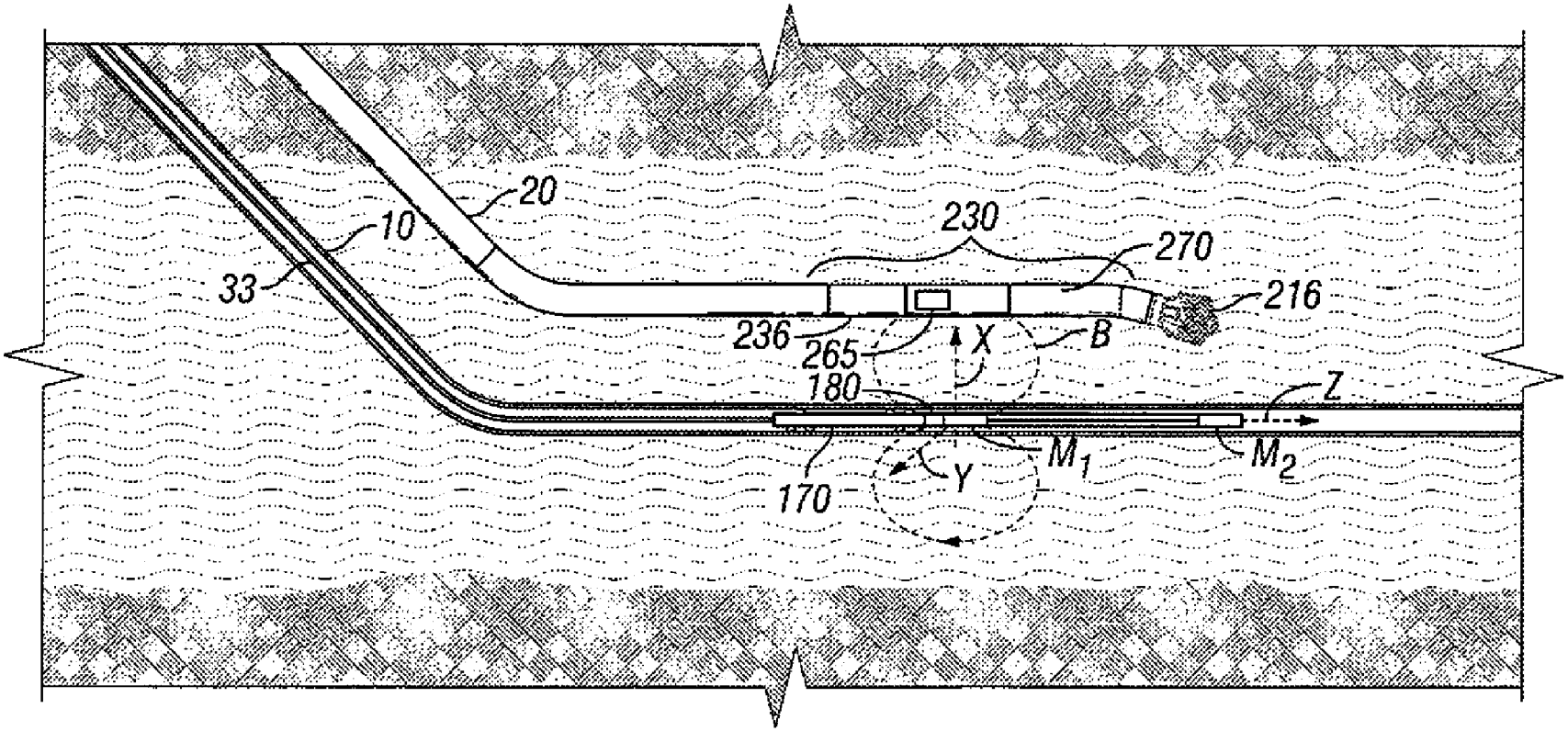

As shown in FIG. 2B, which shows downhole portions of wells 10 and 20, mounted near the drill bit 216, is a bottom hole assembly 230, which conventionally includes, inter alia, MWD subsystems, represented generally at 236, for making measurements, and processing and storing information. One of these subsystems, also includes a telemetry subsystem for data and control communication with the earth's surface. Such apparatus may be of any suitable type, e.g., a mud pulse (pressure or acoustic) telemetry system, wired drill pipe, etc., which receives output signals from the data measuring sensors and transmits encoded signals representative of such outputs to the surface (see FIG. 2A) where the signals are detected, decoded in a receiver subsystem 246, and applied to a processor 248 and/or a recorder 250. The processor 248, and other processors, may comprise, for example, suitably programmed general or special purpose processors. A surface transmitter subsystem 252 is provided for establishing downward communication with the bottom hole assembly by any known technique, such as mud pulse control (as represented by line 252A), wired drill pipe, etc.

The subsystems 236 of the bottom hole assembly also include conventional acquisition and processing electronics (not separately shown) comprising a microprocessor system, with associated memory, clock and timing circuitry. Power for the downhole electronics and motors may be provided by battery and/or, as known in the art, by a downhole turbine generator powered by movement of the drilling fluid. A steerable motor 270 and under control from the surface via the downhole processor, is provided for directional drilling.

The bottom hole assembly subsystems 236 also include one or more magnetometer arrays 265 which, in the present embodiment, preferably include AC magnetometers, all under control of the downhole processor in the bottom hole assembly, which communicates with the uphole processor(s) via the described telemetry subsystem.

In accordance with a feature of the invention, and as illustrated in FIG. 2B, a pair of spaced apart magnetic field sources, denoted by magnetic dipole sources $M_1$ and $M_2$, are provided in a tool mounted on a tractor 170, moveable under control of wireline cable 33. Coiled tubing or other motive means can alternatively be used. In this embodiment, the magnetic dipole sources are solenoids; that is, coils wound on respective magnetic cores. Energizing and control is provided by downhole electronics, which can include a downhole processor, represented in FIG. 2B by block 180, which communicates with the uphole electronics and processor via the wireline.

Figure 3A:
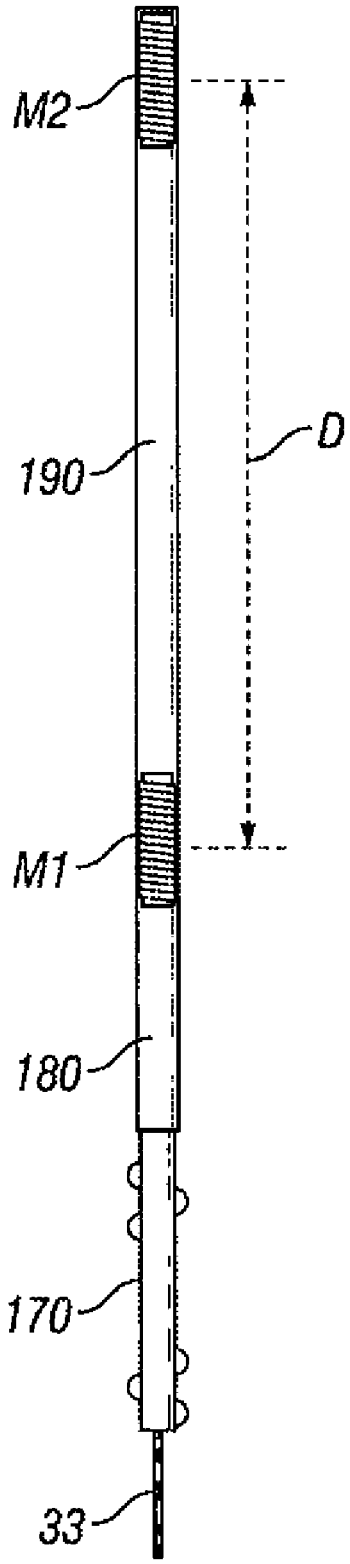
FIGS. 3A and 3B show, respectively, a plan view, partially in block form, and a cross sectional view of equipment that can be used in practicing embodiments of the invention.
Figure 3B:
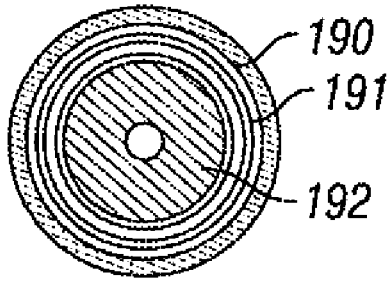

FIG. 3 shows, in further detail, the solenoid $M_1$ and $M_2$ mounted in housing 190. As seen in FIG. 3B, wire windings 191 are wound on a tubular magnetic core 192, the central opening being useful for communicating wiring. The power supply, control electronics, and downhole processor, are housed in cartridge 180.

The solenoids $M_1$ and $M_2$ are aligned with the borehole axis (z-direction) and have a fixed separation d. The solenoids are contained in the non-magnetic housing or non-metallic (e.g. fiberglass) housing 190. The distance between the two solenoids may be set depending on the desired inter-well spacing. For example, if the inter-well spacing is 5 m, then the solenoids should preferably be spaced in the range of 5 m to 10 m. If the inter-well spacing is greater, then a longer spacing is desirable. The solenoids' spacing can be adjusted by inserting spacers or additional housings between them. The downhole tool of the present embodiment is in the form of a wireline logging tool, and electronic cartridge 180 thereof is provided with a capability of producing low frequency AC currents for the solenoids.

As above indicated, the MWD tool in well 20 preferably contains at least one 3-axis magnetometer capable of measuring an AC magnetic field, so that the solenoids of the wireline tool can be driven by an AC current, rather than by a DC current. The advantage is that the Earth's DC magnetic field can be entirely suppressed, and this is achieved in the present embodiment by coupling high pass filters with the magnetometer outputs. Since the 50,000 nTesla Earth's magnetic field is no longer present in the data, much weaker magnetic fields can be accurately measured than is possible for DC magnetic fields. This also can reduce the weight and power requirements for the solenoids and can increase the range between wells.

Preferably, the frequency of the AC current should generally lie in the range of 1 Hz to 20 Hz; a suitable choice being a frequency of approximately 3 Hz. For frequencies much greater than 20 Hz, the magnetic field may be unduly attenuated if the first well has steel casing, or by drill collar material in the MWD tool when the 3-axis magnetometer is located inside the drill collar. The techniques hereof can also be implemented using DC magnetic fields, albeit less conveniently.

Figure 4:
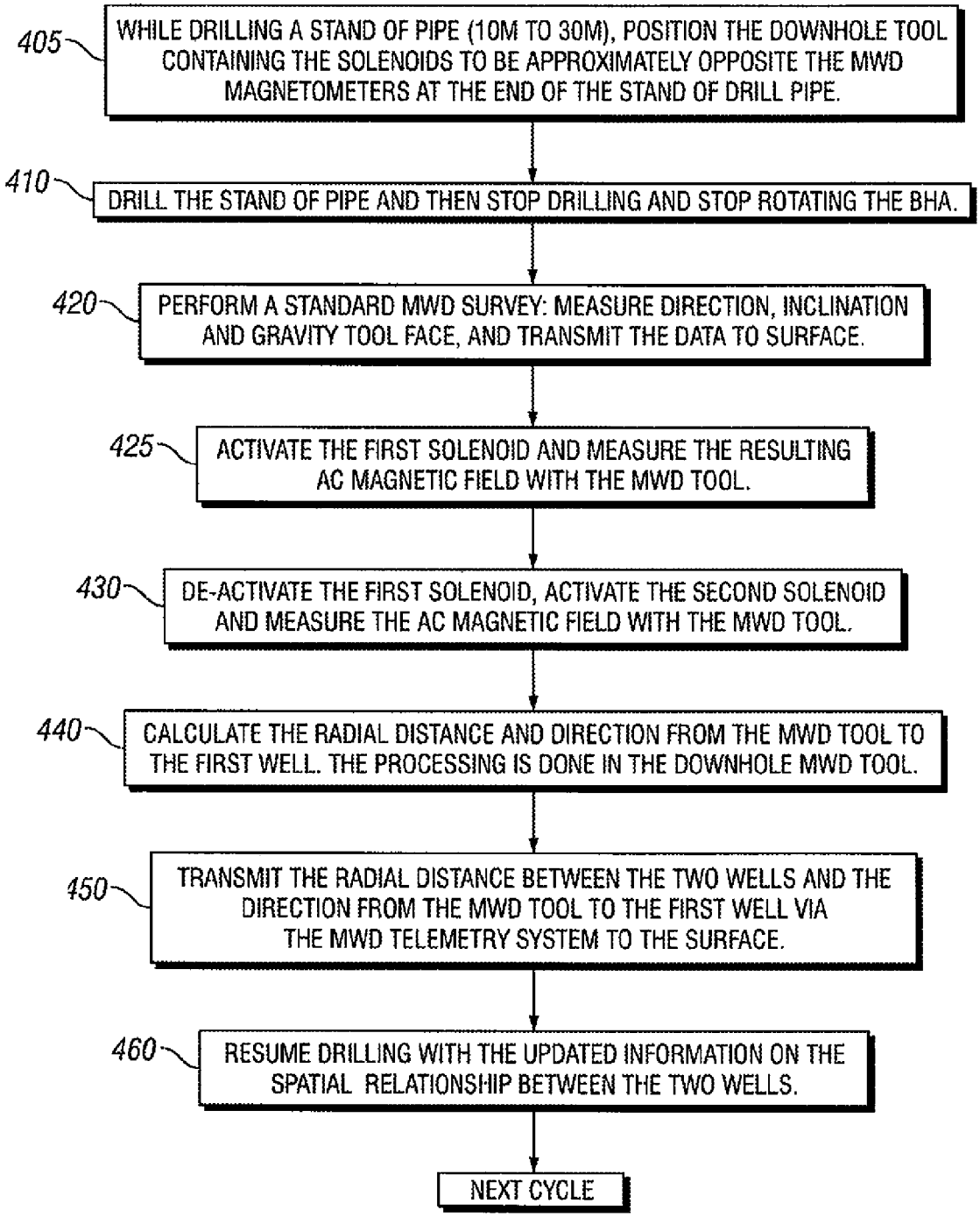
FIG. 4 is a flow diagram showing steps of a method in accordance with an embodiment of the invention.

A flow diagram for a sequence of magnetic ranging and drilling is shown in FIG. 4. As represented by block 405, while drilling a stand of pipe (e.g. 10 m to 30 m), the downhole tool is moved so that this operation does not consume rig time. The downhole tool is moved to be approximately opposite the MWD tool magnetometers when the current stand of drill pipe has been drilled. However, it is not necessary to exactly position the downhole tool. When the "kelly is down", drilling stops and the BHA is not rotating (block 410), a standard MWD survey is performed (block 420) to obtain direction, inclination, and gravity tool face. This data can be transmitted to the surface via MWD telemetry, e.g. by mud pulse or electromagnetic telemetry. Then, the first solenoid in the downhole tool is activated (block 425), preferably by an AC current in the range of 1 to 10 Hz. The resulting AC magnetic field is measured by 3-axis MWD magnetometers and stored in downhole memory. Then, as represented by block 430, the first solenoid is turned off and the second solenoid is activated. Its AC magnetic field is measured by the same 3-axis MWD magnetometers and stored in downhole memory. As described further hereinbelow, the radial distance between the two wells and the direction from one well to the other can be computed downhole (block 440) and then transmitted to the surface (block 450). The time required to transmit the radial distance and direction is much less than transmitting the raw data to the surface, so that drilling can commence (block 460) immediately. The directional drilling is performed in accordance with the received distance and direction information, to maintain the desired alignment and distance of the second well 20 with respect to the first well 10. The next cycle can then be performed to implement the next drilling increment. It will be understood that simultaneous activation of the magnetic field sources, such as at different phases and/or frequencies, with suitable selective filtering of the magnetometer outputs, can alternatively be utilized.

Figure 5:
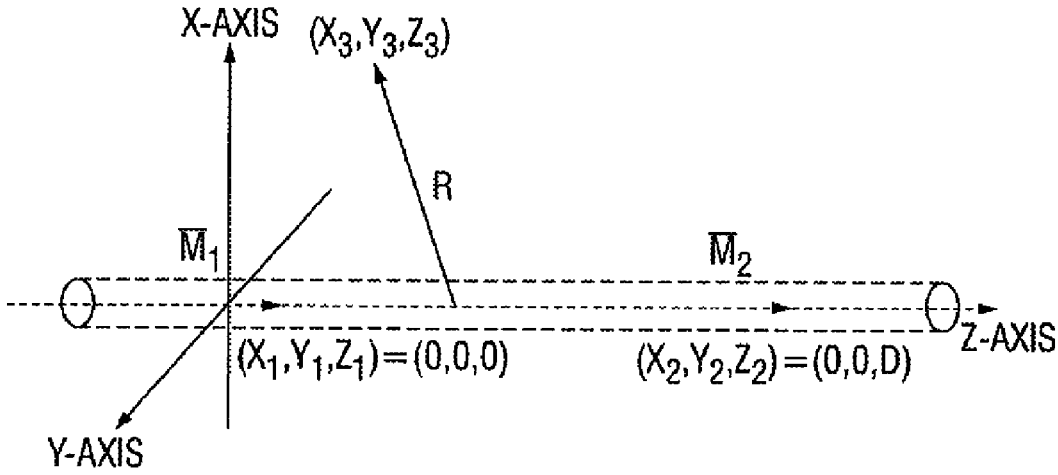
FIG. 5 illustrates the geometry for the two magnetic dipoles on a borehole axis.

Among the objects hereof are to determine the radial distance from the MWD magnetometer in the second well to the borehole axis of the first well and to determine the direction from the MWD magnetometer in the second well to the first well. Referring to FIG. 5, let $\vec{M}_1$ and $\vec{M}_2$ be two magnetic dipole sources (in this case, solenoids) that are located along the borehole axis of the first well. $\vec{M}_1$ is located at $(x_1,y_1,z_1)=(0,0,0)$, and $\vec{M}_2$ is located at $(x_2,y_2,z_2)=(0,0,d)$, where d is the known separation between the two magnetic dipoles. Consider the point $(x_3,y_3,z_3)$ located a radial distance $r=\sqrt{x_3^2+y_3^2}$ from the $\hat{z}$-axis, where $\vec{r}=x_3\hat{x}+y_3\hat{y}$, and where the angle $\theta$ between $\vec{r}$ and $\hat{x}$ is given by $$\tan\theta = \frac{y_3}{x_3}.$$

In general, the best results are obtained when $0 \leqq z_3 \leqq d$, although this condition is not a necessity.

For simplicity, the solenoids will be represented mathematically as point magnetic dipoles that are aligned with the borehole direction. That is, $\vec{M}_1=M_1\hat{z}$ and $\vec{M}_2=M_2\hat{z}$, where $\hat{z}$ is the unit vector pointing along the axis of the first well. The presence of a steel casing or steel liner may perturb the shape of the magnetic field, but this can be taken into account with a slight refinement of the model. The primary effect of the casing is to attenuate the strength of the magnetic field.

Now, consider the situation where the first magnetic dipole $\vec{M}_1$ is activated and the second magnetic dipole is off, i.e. $\vec{M}_2=0$. In general, the magnetic field at $(x_3,y_3,z_3)$ will have field components along the three directions, $\hat{x}$, $\hat{y}$, and $\hat{z}$, such that $\vec{B}_1(x_3,y_3,z_3)=B_{1x}(x_3,y_3,z_3)\hat{x}+B_{1y}(x_3,y_3,z_3)\hat{y}+B_{1z}(x_3,y_3,z_3)\hat{z}$. All three magnetic field components are measured by the 3-axis MWD magnetometer. The three magnetometer axes may not coincide with x, y, and z directions, but it is a simple matter to rotate the three magnetometer readings to the x, y, and z directions based on the MWD survey data.

Figure 6:
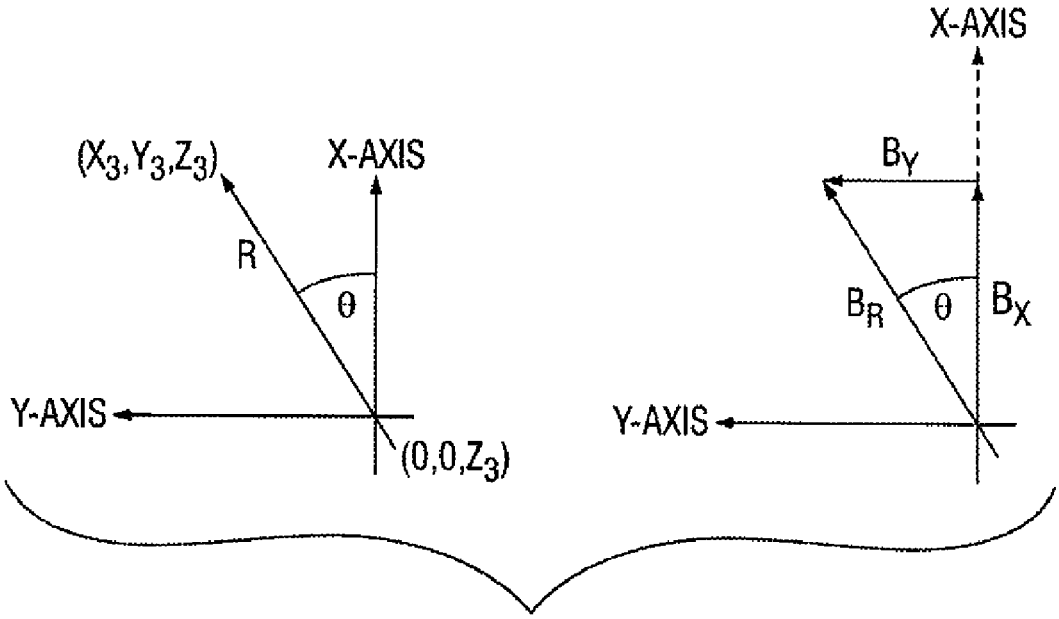
FIG. 6 illustrates geometry useful in determining the direction between wells.

Referring to FIG. 6, the magnetic field along the radial $\vec{r}$ direction is $\vec{B}_{1r}(x_3,y_3,z_3)=B_{1r}(x_3,y_3,z_3)\hat{r}=B_{1x}(x_3,y_3,z_3)\hat{x}+B_{1y}(x_3,y_3,z_3)\hat{y}$, and the direction of $\vec{B}_{1r}(x_3,y_3,z_3)$ is given by $$\tan\theta_1 \frac{B_{1y}}{B_{1x}}.$$

Hereafter, $(x_3,y_3,z_3)$ will be suppressed, e.g. $B_{1y}=B_{1y}(x_3,y_3,z_3)$. Hence, the ratio of the two measured magnetic field components $B_{1y}$ and $B_{1x}$ can be used to determine the direction from the observation point $(x_3,y_3,z_3)$ to a point on the axis of the first well at $(0,0,z_3)$. Note that there can be an ambiguity in the arctangent of 180°. In most circumstances, such as SAGD, the general direction to the first well is sufficiently well known (i.e. down in the case of SAGD) so the 180° ambiguity does not enter.

The magnetic field at the MWD magnetometer with $\vec{M}_1$ activated is given by $$B_{1r} = \frac{\mu_0}{4\pi} 3M_1\left(\frac{z_3}{r}\right)r^{-3}\left[1+\left(\frac{z_3}{r}\right)^2\right]^{-\frac{5}{2}} \text{ and}$$

$$B_{1z} = \frac{\mu_0}{4\pi} M_1\left[2\left(\frac{z_3}{r}\right)^2-1\right]r^{-3}\left[1+\left(\frac{z_3}{r}\right)^2\right]^{-\frac{5}{2}}.$$

Note that $B_{1r}\rightarrow 0$ as $z_3\rightarrow 0$, hence $B_{1x}\rightarrow 0$ and $B_{1y}\rightarrow 0$. This means that it is difficult to determine the angle $$\theta_1 = \arctan\left(\frac{B_{1y}}{B_{1x}}\right)$$

directly across from the first solenoid.

Define the quantities $$u \equiv \frac{z_3}{r} = \frac{z_3}{\sqrt{x_3^2+y_3^2}} \text{ and } \alpha \equiv \frac{B_{1z}}{B_{1r}} = \frac{2u^2-1}{3u},$$

where α is obtained from the measured magnetic field components. Solving the quadratic equation yields $$u = \frac{3\alpha \pm \sqrt{9\alpha^2+8}}{4},$$

where the + sign is used if $z_3>0$ and the − sign is used if $z_3<0$.

In the next step, $\vec{M}_1$ is deactivated, i.e. $\vec{M}_1=0$, and $\vec{M}_2$ is activated. The magnetic field at the MWD magnetometer is now $\vec{B}_2=B_{2x}\hat{x}+B_{2y}\hat{y}+B_{2z}\hat{Z}$. The radial magnetic field can be written as $\vec{B}_{2r}=B_{2r}\hat{r}=B_{2x}\hat{x}+B_{2y}\hat{y}$, and the angle $\theta_2$ obtained from $$\tan\theta_2 = \frac{B_{2y}}{B_{2x}}.$$

The magnetic field at the MWD magnetometer due to $\vec{M}_2$ is $$B_{2r} = \frac{\mu_0}{4\pi} 3M_2\left(\frac{z_3-d}{r}\right)r^{-3}\left[1+\left(\frac{z_3-d}{r}\right)^2\right]^{-\frac{5}{2}} \text{ and}$$

$$B_{2z} = \frac{\mu_0}{4\pi} M_2\left[2\left(\frac{z_3-d}{r}\right)^2-1\right]r^{-3}\left[1+\left(\frac{z_3-d}{r}\right)^2\right]^{-\frac{5}{2}}.$$

Define the quantities $$v \equiv \frac{z_3-d}{r} = \frac{z_3-d}{\sqrt{x_3^2+y_3^2}} \text{ and } \beta \equiv \frac{B_{2z}}{B_{2r}} = \frac{2v^2-1}{3v}.$$

where β is known from the measured magnetic field components. Solving the quadratic equation yields $$v = \frac{3\beta \pm \sqrt{9\beta^2+8}}{4},$$

where the + sign is used if $z_3>d$ and the − sign is used if $z_3<d$.

The quantities u and v are now known from MWD magnetometer data. From $z=r\cdot u=d+r\cdot v$, one obtains the desired radial distance from the MWD magnetometer to the axis of first well, $$r = \frac{d}{u-v}.$$

Note that it is not necessary to know any of the axial positions ($z_1$, $z_2$, or $z_3$) to compute the radial distance between the two wells. The only information required is the known spacing between the two solenoids, $d=z_2-z_1$. However, if it is desired, the axial position of the MWD magnetometer can be computed from $$z_3 = \frac{ud}{u-v}.$$

Then, the direction from the MWD magnetometer to the first well axis is determined by $$\theta = \tan^{-1}\left(\frac{y_3}{x_3}\right) = \frac{1}{2}(\theta_1+\theta_2),$$

with the caveat that the angle can be noisy opposite a solenoid. In this case, it is better to use the magnetic fields from the more distant solenoid. For SAGD wells, the vertical distance between the two wells is given by $x_3=r\cos\theta$ and the horizontal offset between the two wells is given by $y_3=r\sin\theta$.

As described in further detail below, a downhole tool can contain three (or more) solenoids spaced along its length. The processing described above could, for example, be performed with pairs of solenoids to determine the radial distance between the two well bores and the direction from one to the other.

As first described above in conjunction with FIG. 3, the solenoids can be constructed with a magnetic core (e.g. mu-metal) and multiple turns of wire. Typical dimensions for the core can be an outer diameter of 7 cm, and a core length between 2 m and 4 m. As seen in FIG. 3, the magnetic core can have a central hole to allow wires to pass though. In an embodiment hereof, several thousand turns of solid magnetic wire (e.g. #28 gauge) are wrapped over the core and the entire assembly is enclosed in a fiberglass housing. If the downhole tool is to be subjected to high pressures, then the inside of the fiberglass housing can be filled with oil to balance external pressures. If the pressures are less than a few thousand psi, then the housing can be permanently filled with epoxy resin. In one embodiment, the outer diameter of the fiberglass housing is approximately 10 cm.

The magnetic dipole moment is given by $M=N I A_{EF}$ where N is the number of wire turns, I is the current, and $A_{EF}$ is the effective area which includes the amplification provided by the magnetic core. Experiments show that such a solenoid can produce a magnetic moment in air of several thousand amp-meter$^2$ at modest power levels (tens of watts). However, the magnetic dipole moment can be attenuated by 20 dB or more in a cased well. The amount of attenuation depends on the casing properties and on the frequency. The attenuation increases rapidly above about 20 Hz, so a desirable frequency range is 10 Hz and below. Experiments in casing indicate that an effective magnetic dipole moment on the order of a few hundred amp-meter$^2$ can be achieved with casing present.

To calculate the signal-noise ratio for an embodiment hereof, it is assumed that a precision of 0.1 nTesla can be achieved on each magnetometer axis with an AC magnetic field of a few Hertz.

EXAMPLE #1

SAGD Wells at 5 m Separation

Figure 7:
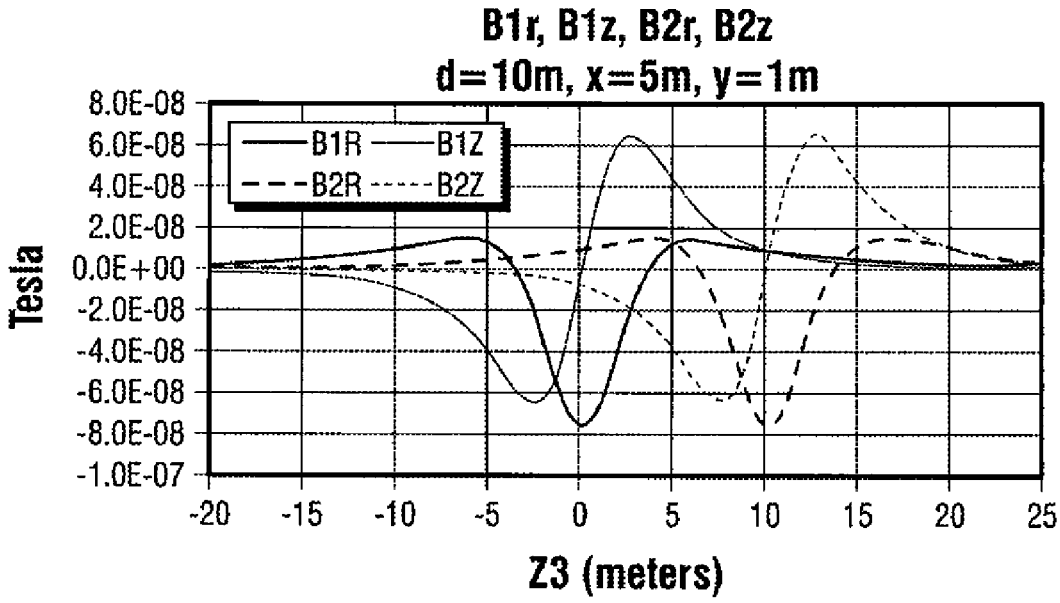
FIG. 7 shows graphs of magnetic field components measured at a magnetometer for an example useful in understanding the invention.
Figure 8:
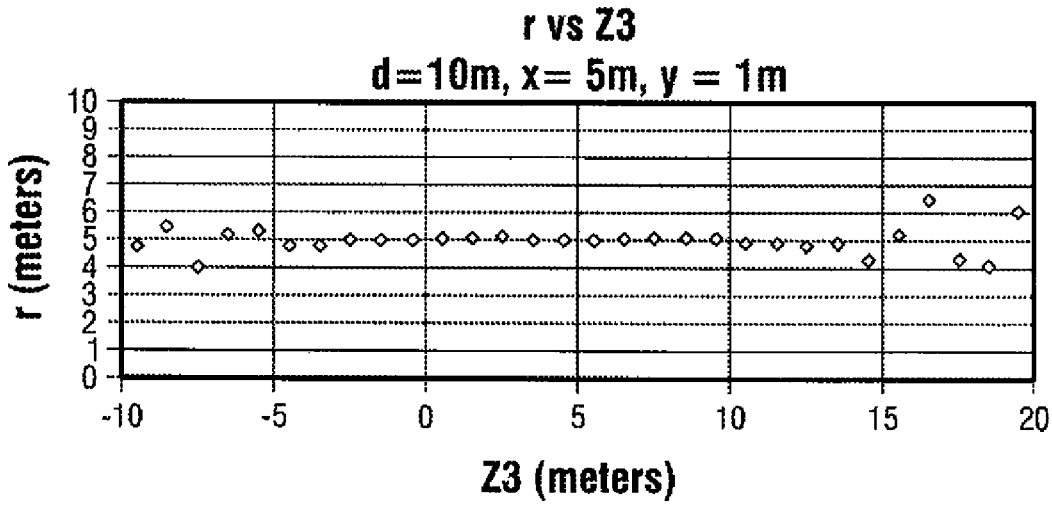
FIG. 8 shows inverted radial distance between the two wells for an example illustrating operation of the invention.
Figure 9:
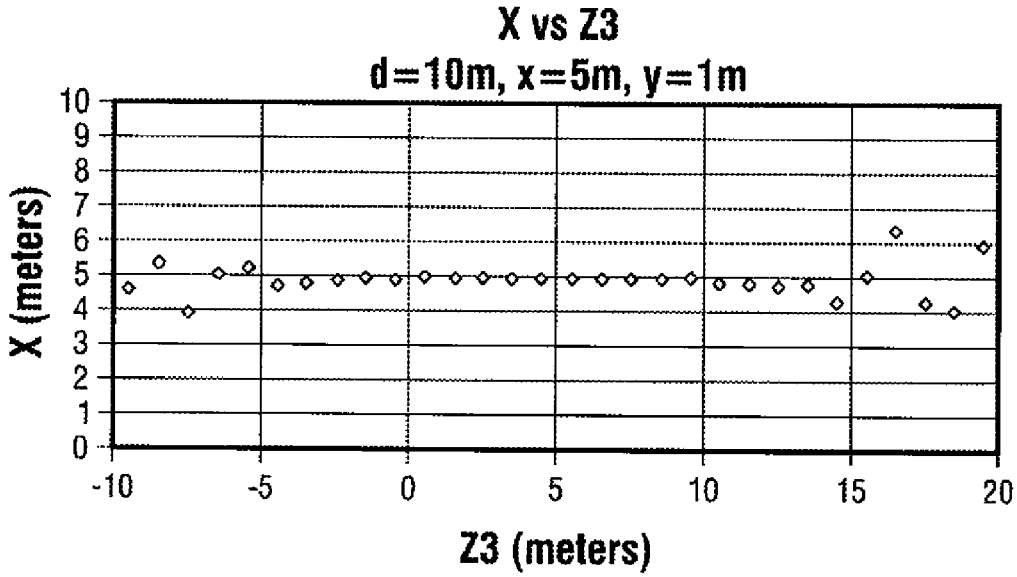
FIG. 9 shows inverted vertical distance between the two wells for an example illustrating operation of the invention.
Figure 10:
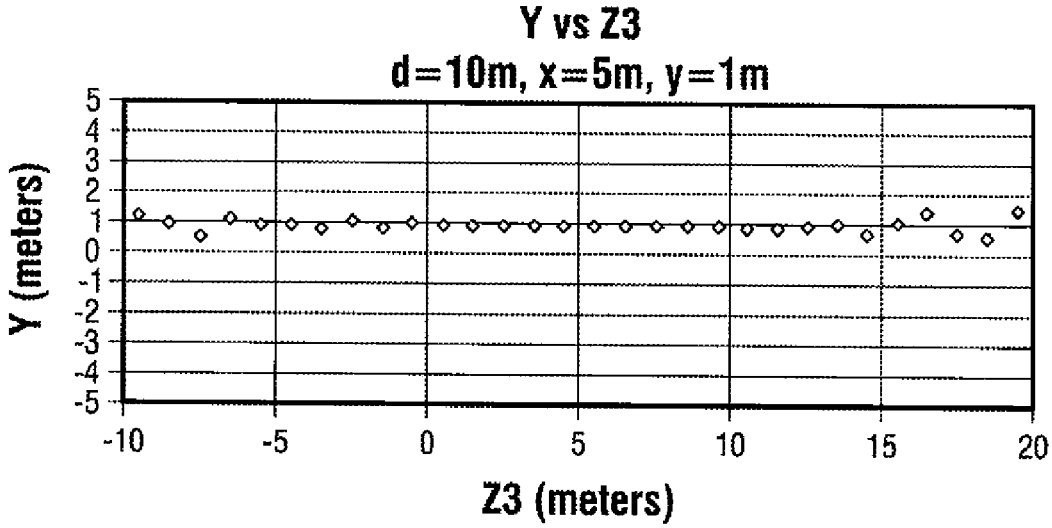
FIG. 10 shows inverted horizontal offset between the two wells for an example illustrating operation of the invention.
Figure 11:
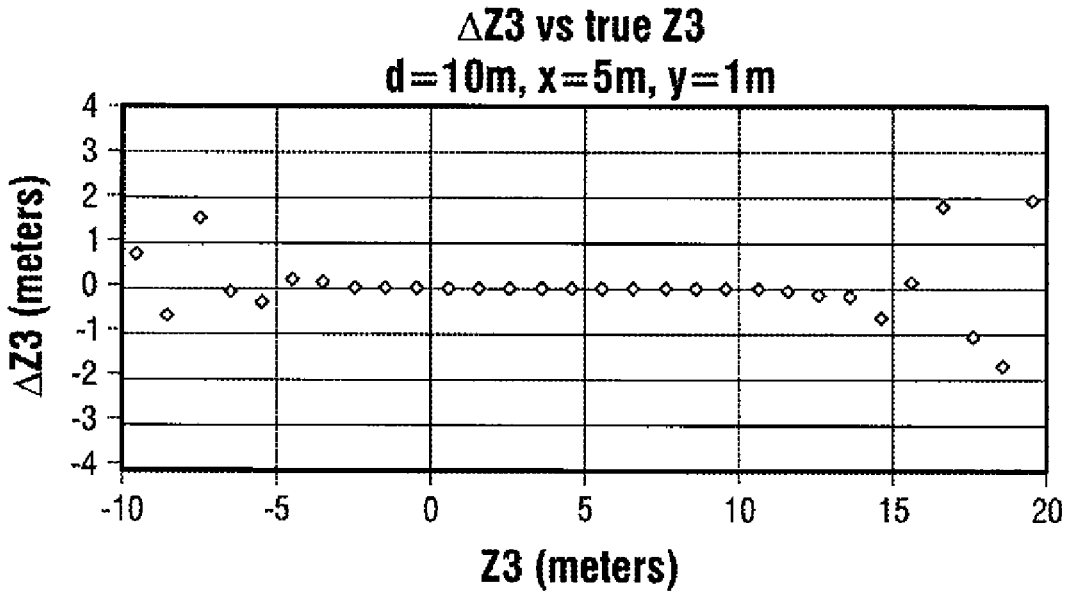
FIG. 11 shows inverted location of the MWD magnetometer along the direction for an example illustrating operation of the invention.

In this example, the two solenoids are separated by a distance d=10 m and each solenoid has a magnetic dipole moment of M=100 amp-meter$^2$. A SAGD injector well is to be drilled 5 m above the producer well. It is assumed that the MWD magnetometer is located at $(x_3,y_3,z_3)=(5\text{ m},1\text{ m},z_3)$, various quantities are plotted as a function of $z_3$. The magnetic field components measured at the magnetometer ($B_{1r}$, $B_{1z}$, $B_{2r}$, and $B_{2z}$) are shown in FIG. 7. Noise with a standard deviation of 0.1 nTesla noise has been added to field components: $B_{1x}$, $B_{1y}$, $B_{1z}$, $B_{2x}$, $B_{2y}$, and $B_{2z}$. Note that the magnetic field is strongest over the range $z_3=-5$ m to $z_3=+15$ m. In FIGS. 8 to 11, the axial position of the MWD magnetometer ($z_3$) is incremented in 1 m steps while inverting for r, $x_3$, $y_3$, and $z_3$, respectively. The average results and standard deviations are also tabulated in Table 1 for two ranges: $z_3 \in [0.5\text{ m},9.5\text{ m}]$ and $z_3 \in [-5.5\text{ m},15.5\text{ m}]$. The difference between the inverted value for $z_3$ and the actual value for $z_3$ is given ($\Delta z_3$). The results are best when $0 \leqq z_3 \leqq d$, and still favorable when $-5 \leqq z_3 \leqq d+5$. These results are well within the tolerances needed for drilling a SAGD well.

TABLE 1

Inverted parameters for example #1. The average value and the standard deviation are given for each range of $z_3$.

| | r (m) | $x_3$ (m) | $y_3$ (m) | $\Delta z_3$ (m) |
|---|---|---|---|---|
| Actual values | 5.10 | 5.00 | 1.00 | 0.00 |
| Inverted values for $z_3 \in [0.5\text{ m}, 9.5\text{ m}]$ | 5.13 ± 0.01 | 5.04 ± 0.01 | 1.00 ± 0.03 | 0.00 ± 0.01 |
| Inverted values for $z_3 \in [-5.5\text{ m}, 15.5\text{ m}]$ | 5.30 ± 0.12 | 5.20 ± 0.14 | 1.04 ± 0.08 | −0.08 ± 0.32 |

EXAMPLE #2

SAGD Wells at 10 m Separation

Figure 12:
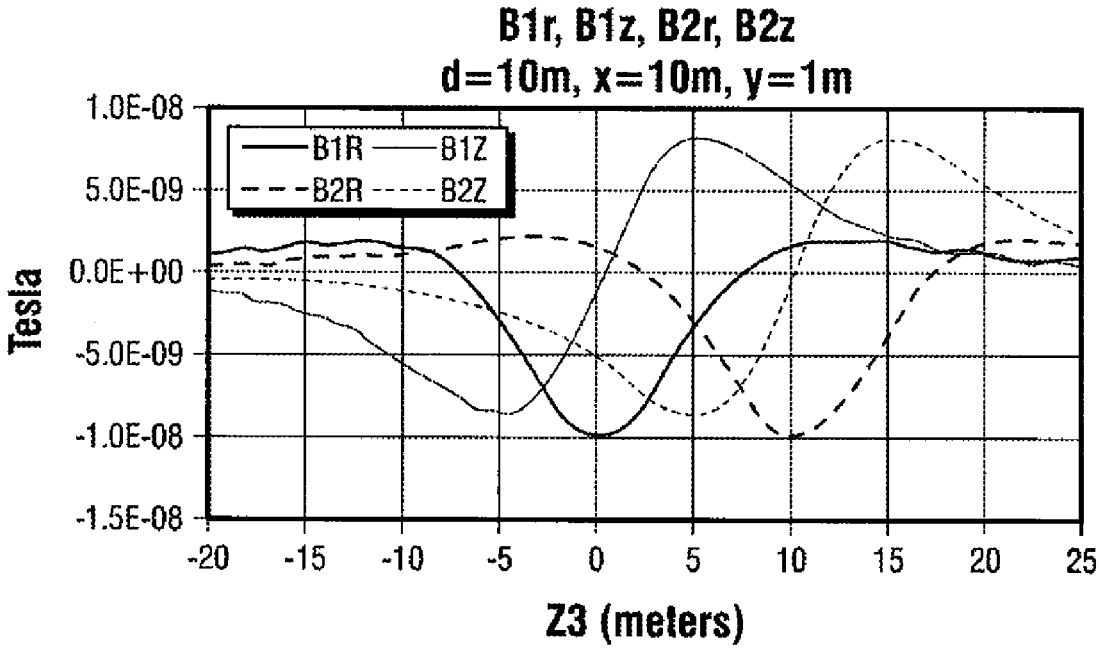
FIG. 12 shows graphs of magnetic field components measured at a magnetometer for another example useful in understanding the invention.
Figure 13:
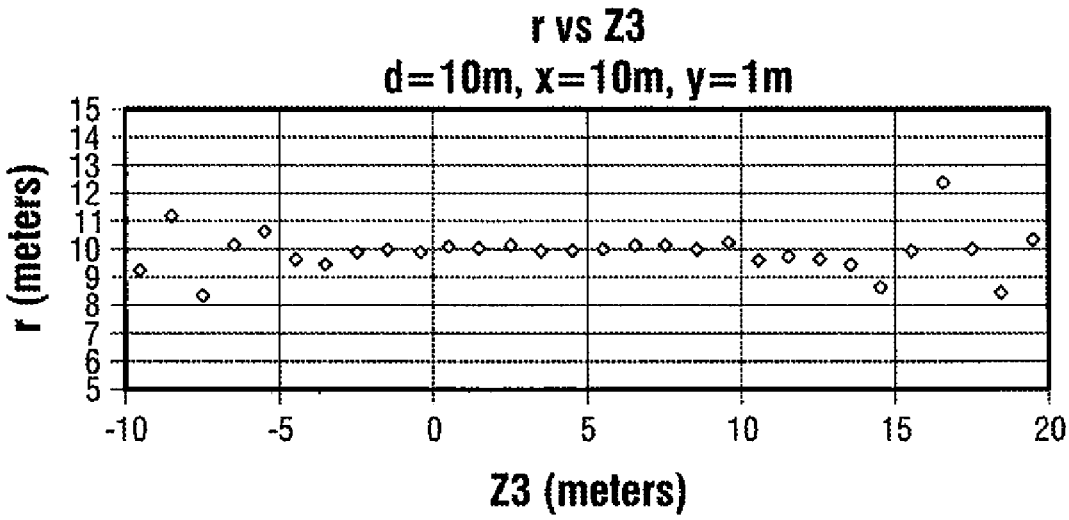
FIG. 13 shows inverted radial distance between the two wells for another example illustrating operation of the invention.
Figure 14:
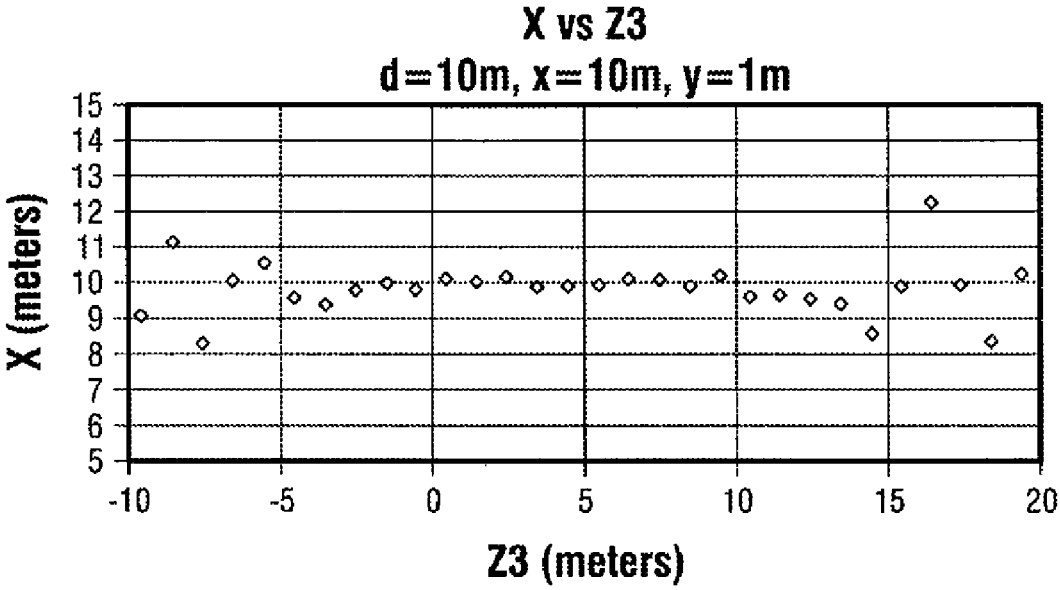
FIG. 14 shows inverted vertical distance between the two wells for another example illustrating operation of the invention.
Figure 15:
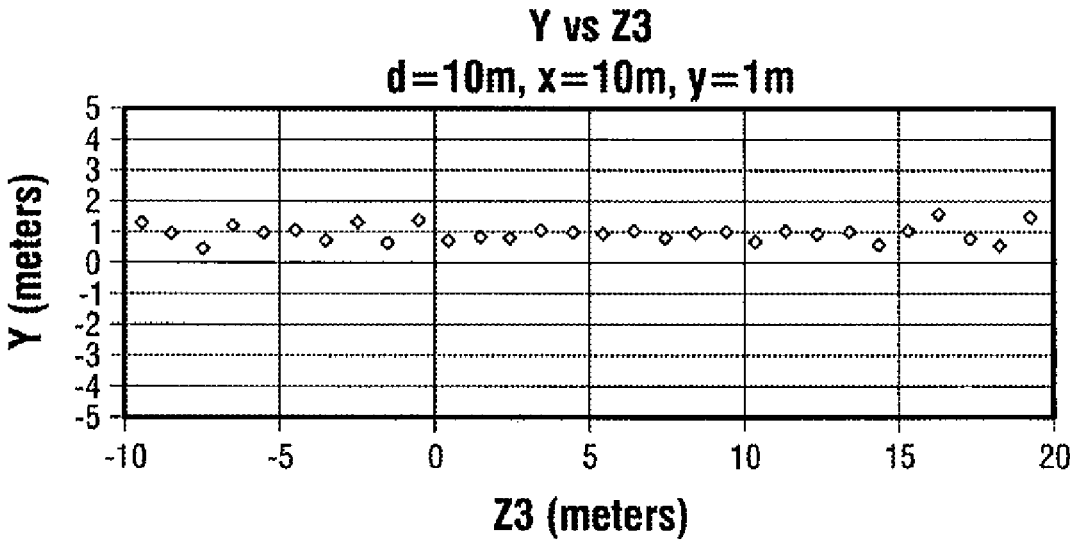
FIG. 15 shows inverted horizontal offset between the two wells for another example illustrating operation of the invention.
Figure 16:
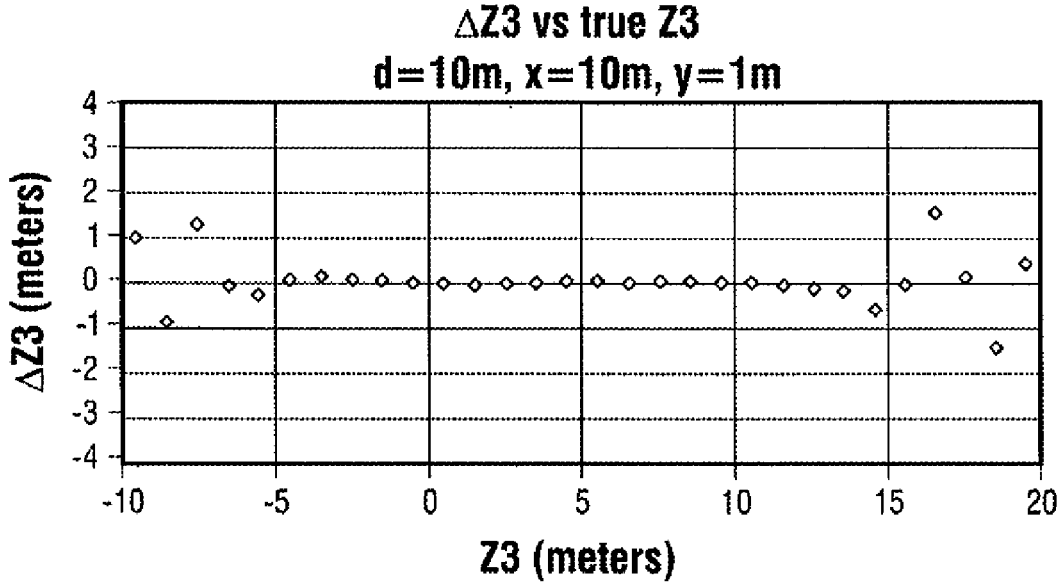
FIG. 16 shows Inverted location of the MWD magnetometer along the z direction for another example illustrating operation of the invention.

In this example, the two solenoids are again separated by a distance d=10 m and each solenoid has a magnetic dipole moment of M=100 amp-meter$^2$. A SAGD injector well is to be drilled 10 m above the producer well. It is assumed that the MWD magnetometer is located at $(x_3,y_3,z_3)=(10\text{ m},1\text{ m},z_3)$, various quantities are plotted as a function of $z_3$. The magnetic field components measured at the magnetometer are shown in FIG. 12. Noise with a standard deviation of 0.1 nTesla noise has been added to all field components. In FIGS. 13 to 16, the axial position of the MWD magnetometer ($z_3$) is varied in 1 m steps while inverting for r, $x_3$, $y_3$, and $z_3$, respectively. The average results and standard deviations are also tabulated in Table 2 for two ranges: $z_3 \in [0.5\text{ m},9.5\text{ m}]$ and $z_3 \in [-5.5\text{ m},15.5\text{ m}]$. The results are still good for $0 \leqq z_3 \leqq d$, and still quite useful for $-5 \leqq z_3 \leqq d+5$.

TABLE 2

Inverted parameters for example #2. The average value and the standard deviation are given for each range of $z_3$.

| | r (m) | $x_3$ (m) | $y_3$ (m) | $\Delta z_3$ (m) |
|---|---|---|---|---|
| Actual values | 10.05 | 10.00 | 1.00 | 0.00 |
| Inverted values for $z_3 \in [0.5\text{ m}, 9.5\text{ m}]$ | 10.23 ± 0.10 | 10.19 ± 0.08 | 0.91 ± 0.24 | 0.01 ± 0.03 |
| Inverted values for $z_3 \in [-5.5\text{ m}, 15.5\text{ m}]$ | 10.31 ± 0.46 | 10.26 ± 0.47 | 1.04 ± 0.06 | −0.14 ± 0.17 |

EXAMPLE #3

SAGD Wells at 15 m Separation

Figure 17:
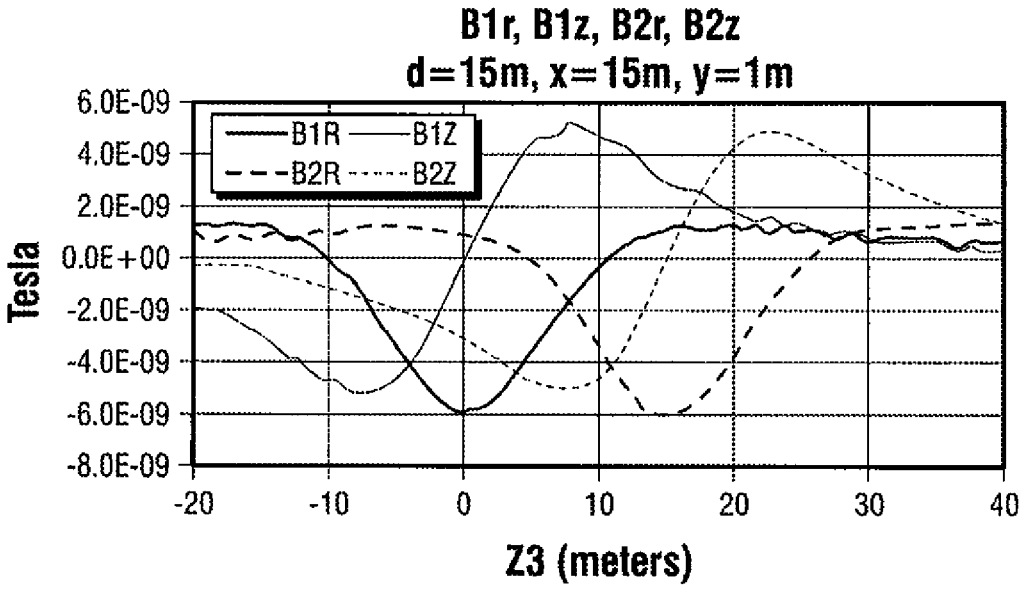
FIG. 17 shows graphs of magnetic field components measured at a magnetometer for a further example useful in understanding the invention.
Figure 18:
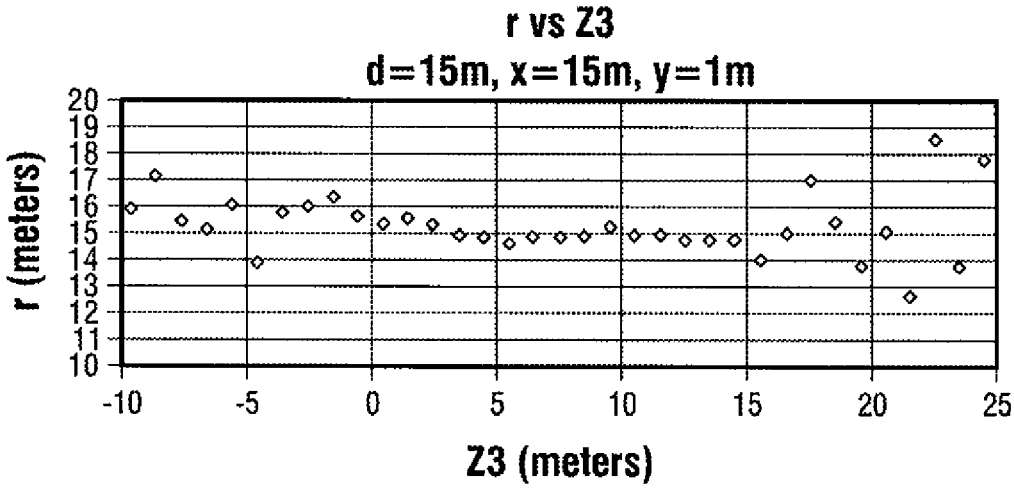
FIG. 18 shows inverted radial distance between the two wells for a further example illustrating operation of the invention.
Figure 19:
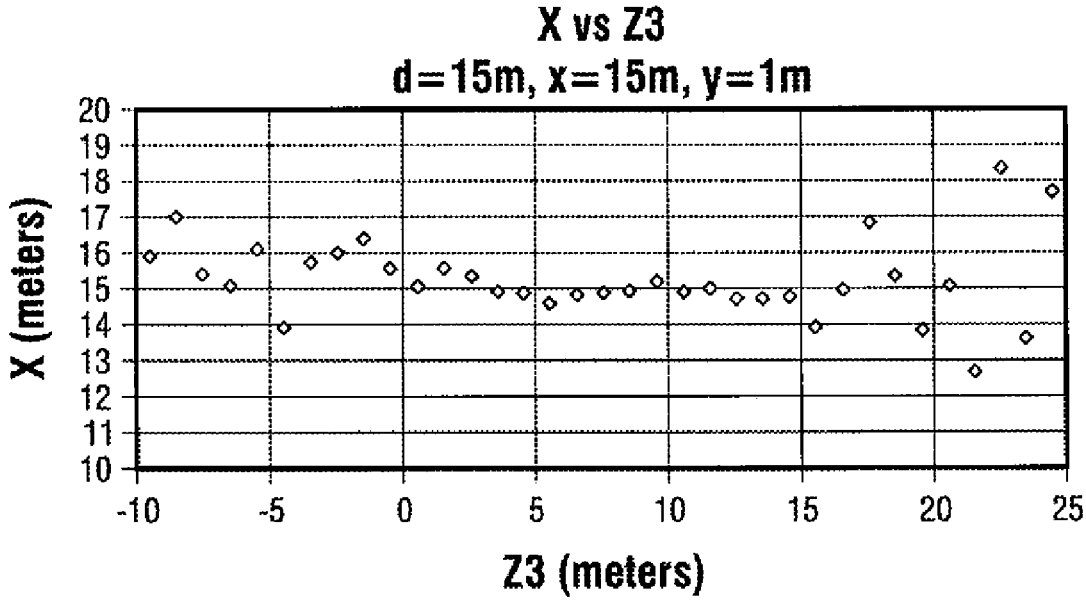
FIG. 19 shows inverted vertical distance between the two wells for a further example illustrating operation of the invention.
Figure 20:
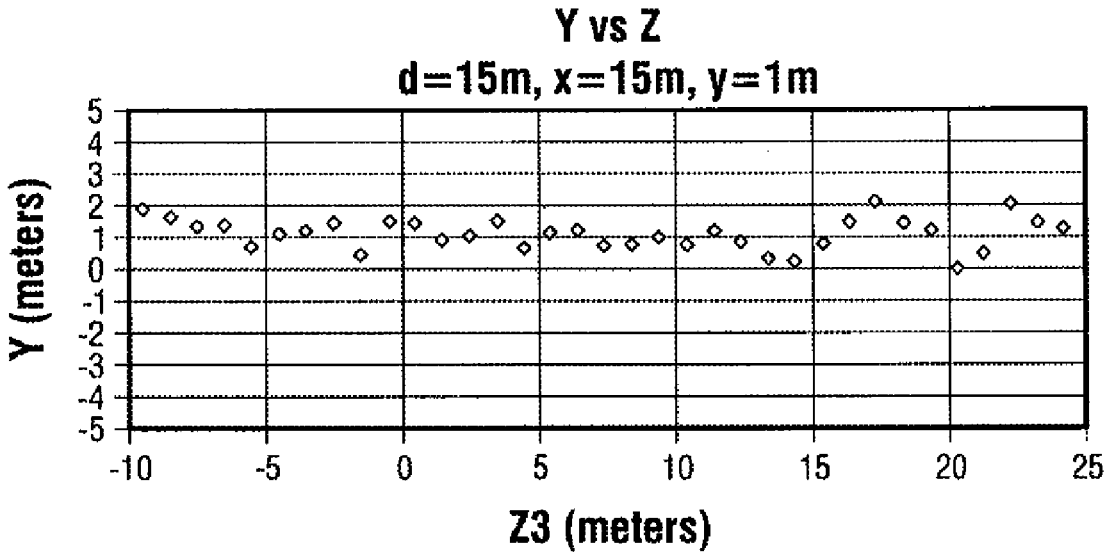
FIG. 20 shows inverted horizontal offset between the two wells for a further example illustrating operation of the invention.
Figure 21:
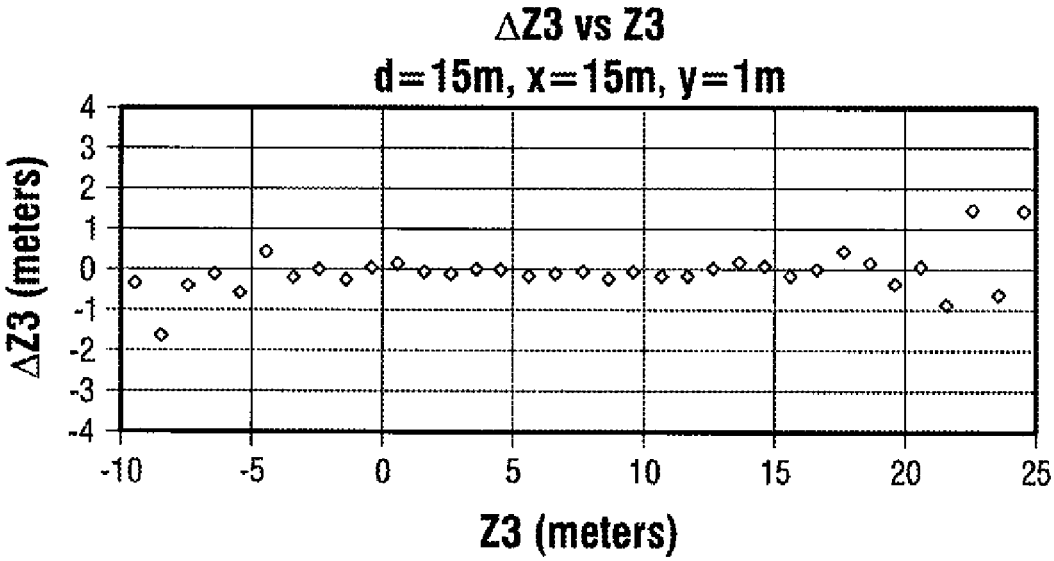
FIG. 21 shows a location of the MWD magnetometer along the z direction for a further example illustrating operation of the invention.

In this case, it is advantageous to separate the two solenoids to d=15 m and to increase the magnetic dipole moment to M=200 amp-meter$^2$. It is assumed that the MWD magnetometer is located at $(x_3,y_3,z_3)=(15\text{ m},1\text{ m},z_3)$, and various quantities are plotted as a function of $z_3$. The magnetic field components measured at the magnetometer are shown in FIG. 17. Noise with a standard deviation of 0.1 nTesla noise has been added to all field components. In FIGS. 18 to 21, the axial position of the MWD magnetometer ($z_3$) is varied in 1 m steps while inverting for r, $x_3$, $y_3$, and $z_3$, respectively. The average results and standard deviations are also tabulated in Table 3 for two ranges: $z_3 \in [0.5\text{ m},14.5\text{ m}]$ and $z_3 \in [-5.5\text{ m},20.5\text{ m}]$. The results provide an accuracy better than 1 m in all conditions, even with a potential uncertainty in $z_3$ of ±13 m.

TABLE 3

Inverted parameters for example #3. The average value and the standard deviation are given for each range of $z_3$.

| | r (m) | $x_3$ (m) | $y_3$ (m) | $\Delta z_3$ (m) |
|---|---|---|---|---|
| Actual values | 15.03 | 15.00 | 1.00 | 0.00 |
| Inverted values for $z_3 \in [0.5\text{ m}, 14.5\text{ m}]$ | 15.11 ± 0.40 | 14.93 ± 0.20 | 0.91 ± 0.86 | 0.04 ± 0.05 |
| Inverted values for $z_3 \in [-5.5\text{ m}, 20.5\text{ m}]$ | 15.64 ± 0.43 | 15.62 ± 0.67 | 0.43 ± 0.45 | 0.03 ± 0.17 |

If the first well is an open hole and the downhole tool can be safely run into the borehole, then a much greater range between the two wells can be accommodated because much stronger magnetic dipole moments are possible. Alternatively, if the noise in the MWD magnetometers can be reduced below 0.1 nTesla, then a greater range is also possible. This may be accomplished by averaging the signals over a longer time interval.

Figure 22:
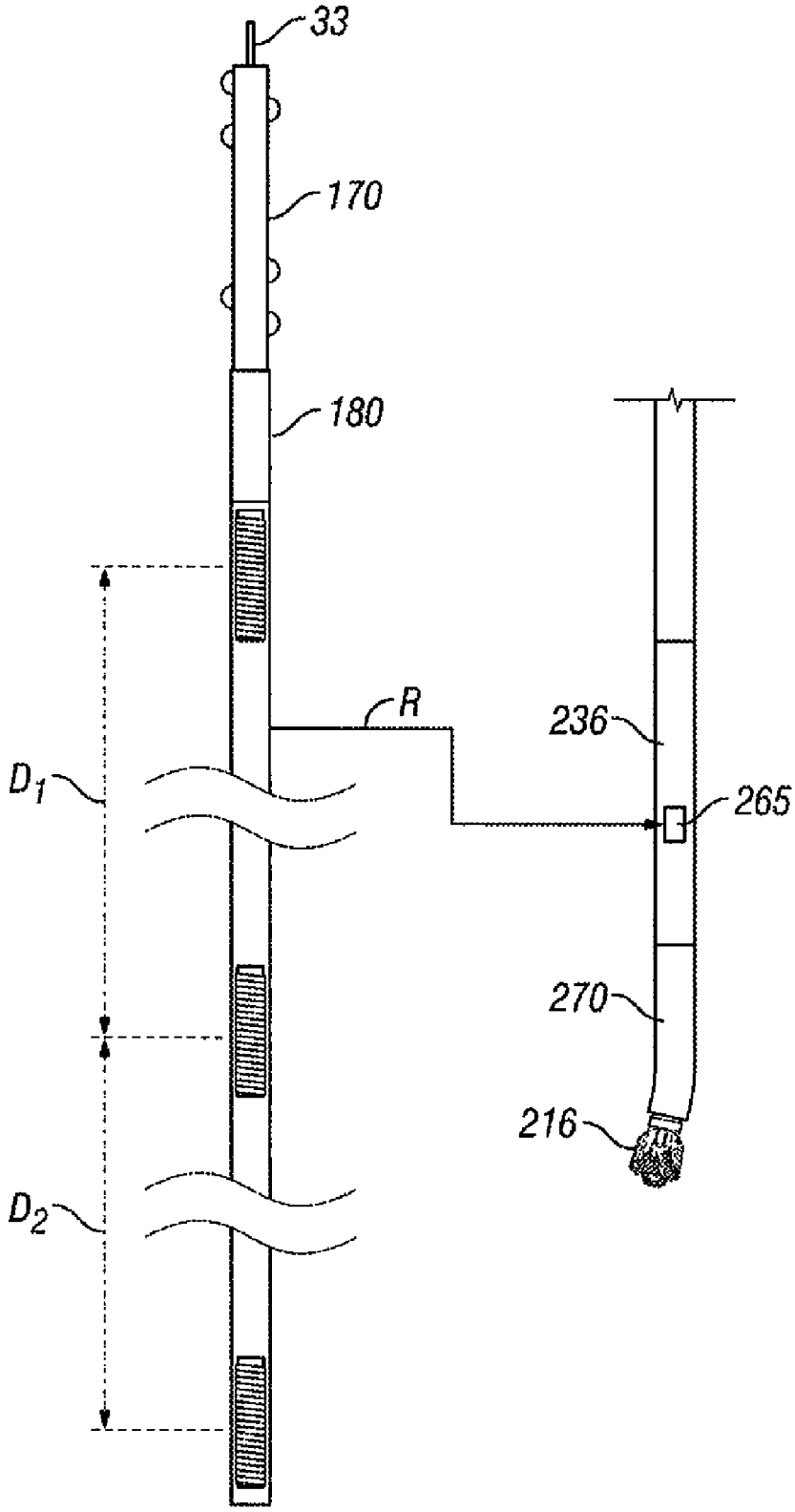
FIG. 22 shows a downhole tool with three solenoids, which can be used in practicing embodiments of the invention.

As above noted, more than two solenoids can be deployed in the downhole tool. For example, FIG. 22 displays a downhole tool with three solenoids, labeled $\vec{M}_1$, $\vec{M}_2$, and $\vec{M}_3$, where $\vec{M}_1$ is located at z=0, $\vec{M}_2$ is located at $z=d_1$, and $\vec{M}_3$ is located at $z=d_1+d_2$. The three solenoids can be activated sequentially in time to produce three corresponding magnetic fields measured at $(x_3,y_3,z_3)$. The three magnetic field readings are composed of radial and axial components: $\vec{B}_1=B_{1r}\hat{r}+B_{1z}\hat{z}$, $\vec{B}_2=B_{2r}\hat{r}+B_{2z}\hat{z}$, and $\vec{B}_3=B_{3r}\hat{r}+B_{3z}\hat{z}$. Define $$u \equiv \frac{z_3}{r},\ \alpha \equiv \frac{B_{1z}}{B_{1r}} = \frac{2u^2-1}{3u},\ v \equiv \frac{z_3-d_1}{r} \text{ and } \beta \equiv \frac{B_{2z}}{B_{2r}} = \frac{2v^2-1}{3v}$$

as before. In addition, define $$w \equiv \frac{z_3-d_1-d_2}{r} \text{ and } \gamma \equiv \frac{B_{3z}}{B_{3r}} = \frac{2w^2-1}{3w}.$$

Since α, β, and γ are measured quantities, the three quadratic equations can be solved yielding $$u = \frac{3\alpha \pm \sqrt{9\alpha^2+8}}{4},\ v = \frac{3\beta \pm \sqrt{9\beta^2+8}}{4}, \text{ and } w = \frac{3\gamma \pm \sqrt{9\gamma^2+8}}{4}.$$

The radial distance can be computed from any two pairs of observations. If the measurements from solenoids $\vec{M}_1$ and $\vec{M}_2$ are used, then $$r = \frac{d_1}{u-v} \text{ and } z_3 = \frac{ud_1}{u-v}.$$

If the measurements from solenoids $\vec{M}_1$ and $\vec{M}_3$ are used, then $$r = \frac{d_1+d_2}{u-w} \text{ and } z_3 = \frac{u(d_1+d_2)}{u-w}.$$

Finally, if the measurements from solenoids $\vec{M}_2$ and $\vec{M}_3$ are used, then $$r = \frac{d_2}{v-w} \text{ and } z_3 = \frac{vd_2}{v-w} + d_1.$$

The potential advantages of using three solenoids include the following. First, there is a greater axial range over which the inversion is accurate because the array is longer. The radial distance can be estimated from the nearest pair of solenoids (e.g. from the pair $\vec{M}_1+\vec{M}_2$ or from the pair $\vec{M}_2+\vec{M}_3$). Second, the accuracy also can be improved by averaging the results from different pairs of solenoids (e.g. from the pair $\vec{M}_1+\vec{M}_2$ and from the pair $\vec{M}_2+\vec{M}_3$). Third, if the radial distance is much greater than $d_1$ or $d_2$, then the most accurate estimate may be given by the pair $\vec{M}_1+\vec{M}_3$. Similarly, arrays with more than three solenoids can be deployed.

Figure 23:
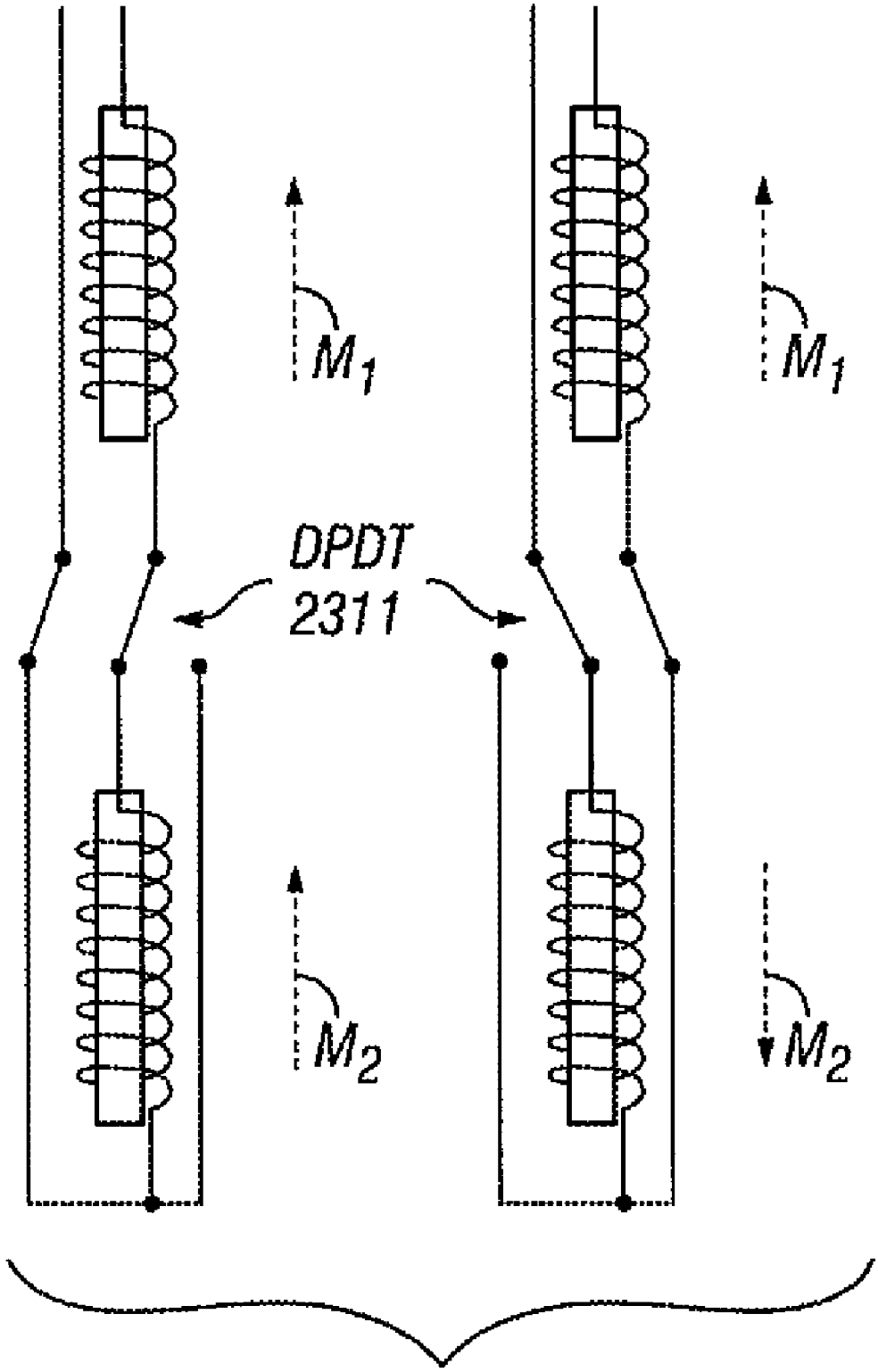
FIG. 23 shows operation of two solenoids in parallel or anti-parallel mode, in accordance with an embodiment of the invention.

Another embodiment of the invention is illustrated in FIG. 23. The two solenoids $\vec{M}_1$ and $\vec{M}_2$ can be driven sequentially in time as previously described, or they can be driven simultaneously in parallel mode and simultaneously in anti-parallel mode. A double pole double throw (DPDT) switch 2311 is used in this embodiment to switch between parallel and anti-parallel modes. In parallel mode, the currents in the two solenoids are in phase so that the two magnetic dipole moments are parallel. In parallel mode, the magnetic field measured at $(x_3,y_3,z_3)$ is $\vec{B}_p=(B_{1r}\hat{r}+B_{1z}\hat{z})+(B_{2r}\hat{r}+B_{2z}\hat{z})$. In anti-parallel mode, the magnetic field measured at $(x_3,y_3,z_3)$ is $\vec{B}_A=(B_{1r}\hat{r}+B_{1z}\hat{z})-(B_{2r}\hat{r}+B_{2z}\hat{z})$. Hence, the magnetic fields from the individual solenoids can be obtained from $$B_{1r}\hat{r}+B_{1z}\hat{z} = \frac{1}{2}\left(\vec{B}_p+\vec{B}_A\right) \text{ and } B_{2r}\hat{r}+B_{2z}\hat{z} = \frac{1}{2}\left(\vec{B}_p-\vec{B}_A\right).$$

Then, the previous analysis can be use to determine the radial distance from the z-axis.

As previously noted, yet another method for obtaining the magnetic fields from the two solenoids is to drive them at two different frequencies. Let solenoid $\vec{M}_1$ be driven by a current at frequency $f_1$ and let solenoid $\vec{M}_2$ driven by a current at frequency $f_2$. Both solenoids can then be activated simultaneously. The magnetic field measured by the magnetometer located at $(x_3,y_3,z_3)$ can be decomposed into the two frequencies by Fourier transform or by other well known signal processing methods. In this manner, the magnetic field contributions from the individual solenoids can be separated, and the previously described processing applied to determine the distance and direction to the z-axis.

The invention claimed is:

1. A method for determining the distance and/or direction of a second earth borehole with respect to a first earth borehole, comprising the steps of:

providing, in the first borehole, first and second spaced apart magnetic field sources;

providing, in the second borehole, a magnetic field sensor subsystem for sensing directional magnetic field components;

activating said first and second magnetic field sources, and producing respective first and second outputs of said magnetic field sensor subsystem, said first output being responsive to the magnetic field produced by said first magnetic field source, and said second output being responsive to the magnetic field produced by said second magnetic field source; and determining said distance and/or direction of said second earth borehole with respect to said first earth borehole as a function of said first output and said second output.

2. The method as defined by claim 1, wherein said step of providing a magnetic field sensor subsystem comprises providing a subsystem for sensing x, y, and z orthogonal magnetic field components, said first output comprises sensed x, y and z magnetic field components responsive to the magnetic field produced by said first magnetic field source, and said second output comprises sensed x, y and z magnetic field components responsive to the magnetic field produced by said second magnetic field source.

3. The method as defined by claim 1, wherein said step of activating said first and second magnetic field sources comprises implementing AC energizing of said magnetic field sources.

4. The method as defined by claim 3, wherein said step of activating said first and second magnetic field sources comprises activating said first and second magnetic field sources sequentially.

5. The method as defined by claim 3, wherein said step of activating said first and second magnetic field sources comprises activating said first and second magnetic field sources simultaneously at different phases and/or frequencies.

6. The method as defined by claim 1, wherein said step of providing first and second magnetic field sources comprises providing first and second magnetic dipole sources.

7. The method as defined by claim 1, wherein said step of providing first and second spaced apart magnetic field sources comprises providing first and second solenoids on a common axis.

8. The method as defined by claim 7, wherein said common axis is substantially parallel to the axis of said first borehole.

9. The method as defined by claim 1, wherein said first and second magnetic field sources are spaced apart by a spacing D, and wherein said step of determining said distance and/or direction of said second earth borehole with respect to said first earth borehole comprises determining said distance and/or direction as a function of said first output, and said second output, and said spacing D.

10. The method as defined by claim 1, further comprising providing, in said first borehole, a third magnetic field source, and wherein said activating step includes activating said third magnetic field source and producing a third output of said magnetic field sensor subsystem, said third output being responsive to the magnetic field produced by said third magnetic field source, and wherein said step of determining said distance and/or direction of said second earth borehole with respect to said first earth borehole comprises determining said distance and/or direction as a function of said first output, said second output, and said third output.

11. The method as defined by claim 10, wherein said step of providing first, second and third magnetic field sources comprises providing first, second and third solenoids on a common axis.

12. The method as defined by claim 11, wherein said step of providing a magnetic field sensor subsystem comprises providing a subsystem for sensing x, y, and z orthogonal magnetic field components, said first output comprises sensed x, y and z magnetic field components responsive to the magnetic field produced by said first magnetic field source, and said second output comprises sensed x, y and z magnetic field components responsive to the magnetic field produced by said second magnetic field source, and said third output comprises sensed x, y, and z magnetic field components responsive to the magnetic field produced by said third magnetic field source.

13. The method as defined by claim 10, wherein said step of activating said first, second and third magnetic field sources comprises implementing AC energizing of said magnetic field sources.

14. The method as defined by claim 13, wherein said step of activating said first, second, and third magnetic field sources comprises activating said first, second, and third, magnetic field sources sequentially.

15. The method as defined by claim 13, wherein said step of activating said first, second, and third magnetic field sources comprises activating said first, second, and third magnetic field sources simultaneously at different phases and/or frequencies.

16. The method as defined by claim 1, wherein said distance determination is performed in a region where said first and second boreholes are generally parallel, and wherein said step of determining said distance and/or direction of said second borehole with respect to said first borehole comprises determining, in said region, a radial distance with respect to said first borehole.

17. The method as defined by claim 1, wherein said distance determination is performed in a region where said first and second boreholes are generally parallel, and wherein said step of determining said distance and/or direction of said second borehole with respect to said first borehole comprises determining, in said region, a radial distance and a direction with respect to said first borehole.

18. A method for drilling of a second earth borehole in a determined spatial relationship to a first borehole, comprising the steps of:

(a) providing, in the first borehole, a plurality of spaced apart magnetic field sources;

(b) providing, in the second borehole, a directional drilling subsystem and a magnetic field sensor subsystem for sensing directional magnetic components;

(c) activating a first and a second of said plurality of magnetic field sources, and producing respective first and second outputs of said magnetic field sensor subsystem, said first output being responsive to the magnetic field produced by said first magnetic field source, and said second output being responsive to the magnetic field produced by said second magnetic field source;

(d) determining the distance and direction of said second earth borehole with respect to said first earth borehole as a function of said first output and said second output;

(e) producing directional drilling control signals as a function of the determined distance and direction; and (f) applying said directional drilling control signals to said directional drilling system to implement a directional drilling increment of said second borehole.

19. The method as defined by claim 18, further comprising advancing, in said first borehole said plurality of spaced apart magnetic field sources; and repeating said steps (c) through (f) to implement a further directional drilling increment of said second borehole.

20. The method comprising repeating the steps of claim 19 a number of times to implement a number of further directional drilling increments of said second borehole.

21. The method as defined by claim 18, further comprising measuring direction, inclination, and gravity tool face of the directional drilling subsystem, and wherein said directional drilling control signals are also a function of said measured direction, inclination, and gravity tool face.

22. The method as defined by claim 18, wherein said step of providing a magnetic field sensor subsystem comprises providing a subsystem for sensing x, y, and z orthogonal magnetic field components, said first output comprises sensed x, y and z magnetic field components responsive to the magnetic field produced by said first magnetic field source, and said second output comprises sensed x, y and z magnetic field components responsive to the magnetic field produced by said second magnetic field source.

23. The method as defined by claim 18, wherein said step of activating said first and second magnetic field sources comprises implementing AC energizing of said magnetic field sources.

24. The method as defined by claim 23, wherein said step of activating said first and second magnetic field sources comprises activating said first and second magnetic field sources sequentially.

25. The method as defined by claim 23, wherein said step of activating said first and second magnetic field sources comprises activating said first and second magnetic field sources simultaneously at different phases and/or frequencies.

26. The method as defined by claim 18, wherein said step of providing a plurality of spaced apart magnetic field sources comprises providing a plurality of solenoids on a common axis.

27. The method as defined by claim 26, wherein said common axis is substantially parallel to the axis of said first borehole.

28. The method as defined by claim 18, wherein said first and second magnetic field sources are spaced apart by a spacing D, and wherein said step of determining said distance and direction of said second earth borehole with respect to said first earth borehole comprises determining said distance and direction as a function of said first output, and said second output, and said spacing D.

29. The method as defined by claim 18, further comprising activating a third of said magnetic field sources, and producing a third output of said magnetic field sensor subsystem, said third output being responsive to the magnetic field produced by said third magnetic field source, and wherein said step of determining said distance and direction of said second earth borehole with respect to said first earth borehole comprises determining said distance and direction as a function of said first output, said second output, and said third output.

30. The method as defined by claim 29, wherein said step of providing a magnetic field sensor subsystem comprises providing a subsystem for sensing x, y, and z orthogonal magnetic field components, said first output comprises sensed x, y and z magnetic field components responsive to the magnetic field produced by said first magnetic field source, and said second output comprises sensed x, y and z magnetic field components responsive to the magnetic field produced by said second magnetic field source, and said third output comprises sensed x, y, and z magnetic field components responsive to the magnetic field produced by said third magnetic field source.

31. The method as defined by claim 29, wherein said step of activating said first, second and third magnetic field sources comprises implementing AC energizing of said magnetic field sources.

32. The method as defined by claim 18, wherein said distance and direction determination is performed in a region where said first and second boreholes are generally parallel, and wherein said step of determining said distance and direction of said second borehole with respect to said first borehole comprises determining, in said region, a radial distance and direction with respect to said first borehole.

33. A system for monitoring the distance and/or direction of a second earth borehole with respect to a first earth borehole, comprising:

a first subsystem movable through said first borehole, said first subsystem including a plurality of spaced apart magnetic field sources and an energizer module for activating at least a first and second of said magnetic field sources; and a second subsystem movable through said second borehole, and including a magnetic field sensor for sensing directional magnetic field components, said second subsystem being operative to produce a first output responsive to the magnetic field produced by said first magnetic field source and a second output responsive to the magnetic field produced by said second magnetic field source;

said distance and/or direction being determinable from said first and second outputs.

34. The system as defined claim 33, further comprising a processor for determining said distance and/or direction as a function of said first and second outputs.

35. The system as defined by claim 34, wherein said processor comprises a downhole processor.

36. The system as defined by claim 33, wherein said plurality of magnetic field sources comprise a plurality of spaced apart solenoids on a common axis.

37. The system as defined by claim 33, wherein said energizing module includes a AC energizing source.

38. The method as defined by claim 33, wherein said energizing module is operative to activate said first and second magnetic field sources sequentially.

39. The method as defined by claim 33, wherein said energizing module is operative to activate said first and second magnetic field sources simultaneously at different phases and/or frequencies.

40. The system as defined by claim 33, wherein said energizing module is operative for activating a third of said magnetic field sources, and wherein said second subsystem is operative to produce a third output responsive to the magnetic field produced by said third magnetic field source, and wherein said distance and/or direction is determinable from said first, second, and third outputs.

* * * * *